US007971661B2

(12) United States Patent
Johnson et al.

(10) Patent No.: US 7,971,661 B2
(45) Date of Patent: Jul. 5, 2011

(54) MOTOR BIT SYSTEM

(75) Inventors: Ashley Bernard Johnson, Milton (GB); Geoffrey C. Downton, Sugar Land, TX (US); John M. Cook, Cambridge (GB)

(73) Assignee: Schlumberger Technology Corporation, Cambridge, MA (US)

( * ) Notice: Subject to any disclaimer, the term of this patent is extended or adjusted under 35 U.S.C. 154(b) by 319 days.

(21) Appl. No.: 12/191,204

(22) Filed: Aug. 13, 2008

(65) Prior Publication Data

US 2010/0038140 A1 Feb. 18, 2010

(51) Int. Cl.
*E21B 17/10* (2006.01)

(52) U.S. Cl. ..... 175/408; 175/73

(58) Field of Classification Search ..... 175/61, 175/73, 406, 95, 96, 92, 408, 103
See application file for complete search history.

(56) References Cited

U.S. PATENT DOCUMENTS

| | | | | |
|---|---|---|---|---|
| 2,016,042 | A | | 10/1935 | Lewis |
| 3,224,513 | A | * | 12/1965 | Weeden, Jr. ..... 340/853.4 |
| 3,285,349 | A | | 11/1966 | Brandon |
| 4,190,123 | A | | 2/1980 | Roddy |
| 4,211,292 | A | | 7/1980 | Evans |
| 4,319,649 | A | | 3/1982 | Jeter |
| 4,690,229 | A | | 9/1987 | Raney |
| 4,739,843 | A | | 4/1988 | Burton |
| 4,775,017 | A | * | 10/1988 | Forrest et al. ..... 175/65 |
| 4,807,708 | A | | 2/1989 | Forrest et al. |
| 4,842,083 | A | | 6/1989 | Raney |
| 5,010,789 | A | | 4/1991 | Brett et al. |
| 5,042,596 | A | | 8/1991 | Brett et al. |
| 5,090,492 | A | | 2/1992 | Keith |
| 5,113,953 | A | | 5/1992 | Noble |
| 5,163,524 | A | | 11/1992 | Newton, Jr. et al. |
| 5,213,168 | A | | 5/1993 | Warren et al. |
| 5,265,682 | A | * | 11/1993 | Russell et al. ..... 175/45 |
| 5,339,910 | A | | 8/1994 | Mueller |
| 5,341,886 | A | | 8/1994 | Patton |
| 5,343,964 | A | * | 9/1994 | Leroy ..... 175/61 |
| 5,361,859 | A | | 11/1994 | Tibbitts |
| 5,423,389 | A | | 6/1995 | Warren et al. |
| 5,490,569 | A | * | 2/1996 | Brotherton et al. ..... 175/61 |
| 5,520,255 | A | | 5/1996 | Barr et al. |
| 5,553,678 | A | | 9/1996 | Barr et al. |
| 5,553,679 | A | | 9/1996 | Thorp |
| 5,582,259 | A | | 12/1996 | Barr |
| 5,603,385 | A | | 2/1997 | Colebrook |
| 5,649,604 | A | | 7/1997 | Fuller et al. |
| 5,651,421 | A | | 7/1997 | Newton et al. |

(Continued)

FOREIGN PATENT DOCUMENTS

BE 1012545 A3 12/2000

(Continued)

*Primary Examiner* — Daniel P Stephenson
(74) *Attorney, Agent, or Firm* — Helene Raybaud; Brigid Laffey

(57) ABSTRACT

The drill bit system may include a chassis, a head, and a first plurality of gauge pads. The chassis may be configured to be operably coupled with a first rotational motion source. The head may include a first plurality of cutters coupled with an end of the head, and the head may be rotatably coupled with chassis. The head may be configured to be operably coupled with a second rotational motion source. The first plurality of gauge pads may include a second plurality of cutters, and the first plurality of gauge pads may be fixedly coupled with the chassis.

30 Claims, 18 Drawing Sheets

U.S. PATENT DOCUMENTS

| | | | | |
|---|---|---|---|---|
| 5,673,763 | A | 10/1997 | Thorp | |
| 5,685,379 | A | 11/1997 | Barr et al. | |
| 5,695,015 | A | 12/1997 | Barr et al. | |
| 5,697,461 | A * | 12/1997 | Newton et al. | 175/331 |
| 5,706,905 | A | 1/1998 | Barr | |
| 5,778,992 | A * | 7/1998 | Fuller | 175/73 |
| 5,803,185 | A | 9/1998 | Barr et al. | |
| 5,803,196 | A | 9/1998 | Fielder | |
| 5,836,406 | A | 11/1998 | Schuh | |
| 5,971,085 | A | 10/1999 | Colebrook | |
| 5,979,577 | A | 11/1999 | Fielder | |
| 6,089,332 | A | 7/2000 | Barr et al. | |
| 6,092,610 | A | 7/2000 | Kosmala et al. | |
| 6,142,250 | A | 11/2000 | Griffin et al. | |
| 6,158,529 | A | 12/2000 | Dorel | |
| 6,244,361 | B1 | 6/2001 | Comeau et al. | |
| 6,290,007 | B2 | 9/2001 | Beuershausen et al. | |
| 6,360,831 | B1 | 3/2002 | Akesson et al. | |
| 6,364,034 | B1 | 4/2002 | Schoeffler | |
| 6,394,193 | B1 | 5/2002 | Askew | |
| 6,427,792 | B1 | 8/2002 | Roberts et al. | |
| 6,601,658 | B1 | 8/2003 | Downton | |
| 6,629,476 | B2 | 10/2003 | Fielder et al. | |
| 6,904,984 | B1 | 6/2005 | Estes et al. | |
| 6,971,459 | B2 | 12/2005 | Raney | |
| 7,287,604 | B2 | 10/2007 | Aronstam et al. | |
| 7,308,955 | B2 | 12/2007 | Barton et al. | |
| 7,757,784 | B2 * | 7/2010 | Fincher et al. | 175/57 |
| 2001/0052428 | A1 | 12/2001 | Larronde et al. | |
| 2002/0011359 | A1 | 1/2002 | Webb et al. | |
| 2002/0020565 | A1 | 2/2002 | Hart et al. | |
| 2005/0056463 | A1 | 3/2005 | Aronstam et al. | |
| 2005/0236187 | A1 | 10/2005 | Chen et al. | |
| 2006/0237234 | A1 * | 10/2006 | Dennis et al. | 175/95 |
| 2006/0249287 | A1 | 11/2006 | Downton et al. | |
| 2007/0007000 | A1 | 1/2007 | Dewey et al. | |
| 2007/0272445 | A1 | 11/2007 | Cariveau et al. | |
| 2008/0000693 | A1 | 1/2008 | Hutton | |
| 2008/0115974 | A1 | 5/2008 | Johnson et al. | |
| 2009/0044979 | A1 | 2/2009 | Johnson et al. | |
| 2009/0044980 | A1 | 2/2009 | Sheppard et al. | |

FOREIGN PATENT DOCUMENTS

| | | | |
|---|---|---|---|
| EP | 0530045 | A1 | 3/1993 |
| EP | 0707131 | A2 | 4/1996 |
| EP | 0707131 | A3 | 10/1996 |
| EP | 1227214 | A2 | 7/2002 |
| EP | 1227214 | A3 | 3/2003 |
| GB | 2257182 | A | 1/1993 |
| GB | 2285651 | A | 7/1995 |
| GB | 2304759 | A | 3/1997 |
| GB | 2343470 | A | 5/2000 |
| GB | 2355744 | A | 5/2001 |
| GB | 2367626 | A | 4/2002 |
| GB | 2408526 | A | 8/2006 |
| GB | 2423102 | A | 8/2006 |
| GB | 2423546 | A | 8/2006 |
| GB | 2425790 | A | 11/2006 |
| GB | 2439661 | A | 1/2008 |
| WO | 9619635 | A1 | 6/1996 |
| WO | 9747848 | A1 | 12/1997 |
| WO | 9815710 | A1 | 4/1998 |
| WO | 9928587 | A1 | 6/1999 |
| WO | 0121927 | A2 | 3/2001 |
| WO | 0236924 | A2 | 5/2002 |
| WO | 03/004824 | A1 | 1/2003 |
| WO | 03052237 | A1 | 6/2003 |
| WO | 03/097989 | A1 | 11/2003 |
| WO | 2004104360 | A2 | 12/2004 |
| WO | 2004113664 | A1 | 12/2004 |
| WO | 2006012186 | A1 | 2/2006 |
| WO | 2007012858 | A1 | 2/2007 |

* cited by examiner

MOTOR BIT SYSTEM

This application is related to U.S. patent application Ser. No. 12/191,230, filed on the same date as the present application, entitled "COMPLIANTLY COUPLED GAUGE PAD SYSTEM WITH MOVABLE GAUGE PADS", which is incorporated by reference in its entirety for all purposes.

This application is related to U.S. patent application Ser. No. 12/191,172, filed on the same date as the present application, entitled "COMPLIANTLY COUPLED CUTTING SYSTEM", which is incorporated by reference in its entirety for all purposes.

BACKGROUND

Embodiments of this invention relate generally to drilling. More specifically, but not by way of limitation, systems and methods are described for controlling and/or harnessing the vibration of various portions of a drill bit, as well as for directionally drilling cavities drilled in/through earthen formations.

Drill bits used for drilling in earthen formations, as well as other mediums, often have cutters on the head of the drill bit and ridges on the sides of the drill bit. The ridges on the side of the bits are often referred to as gauge pads, and may serve to confine or direct the cutters on the head of the drill bit to a continued path through the medium related to the path already taken by the cutters on the head. In some drill bits, cutters may be placed on all or a portion of the gauge pads.

Interactions between the gauge pads and the bore wall of the cavity, which are not intended to be as significant as the interaction of the cutters on the head of the drill bit with the cutting face of the borehole can cause backward whirl. Backward whirl may cause damage to cutters both close to the center of the bit, as well as cutters outward from the center.

Energy wasted by the reaction of the gauge pads with the borehole wall of the cavity may be wasteful in at least two respects. First, any energy wasted by damaging the cutters on the drill bit head is energy which is not being applied to maximize drilling force, and hence speed, through the medium. Second, damage to the cutters on the drill bit head eventually requires the drill bit to be replaced, reducing speed and increasing cost of drilling.

The prior art is therefore deficient in providing a system for avoiding these harmful forces and/or causing them to only occur in favorably lateral directions when steering a drill bit during directional drilling. Embodiments of the present invention provide solutions to these and other problems.

BRIEF DESCRIPTION OF THE INVENTION

In one embodiment of the present invention, a drill bit system for a drilling assembly is provided. The drill bit system may include a chassis, a head, and a first plurality of gauge pads. For purposes of this description, the terms a plurality of gauge pads, a first plurality of gauge pads, a second plurality of gauge pads, gauge pads and/or the like should be read to include embodiments, aspects, descriptions, systems and/or methods comprising a single gauge pad. The head may include a first plurality of cutters coupled with an end of the head, and the head may be coupled with chassis. The first plurality of gauge may be movably coupled with the chassis. In some aspects, the gauge pads may include a second plurality of cutters.

In another embodiment of the invention, another drill bit system for a drilling assembly is provided. The drill bit system may include a first means, a second means, a third means, and a fourth means. The first means may be for coupling the drill bit system with the drilling assembly. The second means may be for drilling longitudinally into a medium. The third means may be for controlling lateral movement of the second means in the medium. The fourth means for movably coupling the third means with the second means.

In another embodiment of the invention, a method of drilling a borehole in a medium is provided. The method may include providing a drill bit, where the drill bit includes a drill head, a compliant coupling, and a plurality of gauge pads. The drill head may have a first plurality of cutters, the compliant coupling may be coupled with the drill head, and the plurality of gauge pads may be coupled with the compliant coupling. The method may also include rotating the drill head against a face of the borehole.

In another embodiment of the invention, another drill bit system for a drilling assembly is provided. The drill bit system may include a chassis, a head, and a first plurality of gauge pads. The head may include a first plurality of cutters coupled with an end of the head, and the head may be movably coupled with chassis. The first plurality of gauge pads may be fixedly coupled with the chassis. In some aspects, the first plurality of gauge pads may include a second plurality of cutters.

In another embodiment of the invention, another drill bit system for a drilling assembly is provided. The drill bit system may include a chassis, a head, and a first plurality of gauge pads. The head may include a first plurality of cutters coupled with an end of the head, and the head may be movably coupled with chassis. The first plurality of gauge pads may be movably coupled with the chassis. In some aspects, the first plurality of gauge pads may include a second plurality of cutters.

In another embodiment of the invention, another drill bit system for a drilling assembly is provided. The drill bit system may include a first means, a second means, a third means, and a fourth means. The first means may be for coupling the drill bit system with the drilling assembly. The second means may be for drilling longitudinally into a medium. The third means may be for controlling lateral movement of the second means in the medium. The fourth means may be for movably coupling the second means with the first means.

In another embodiment of the invention, another method of drilling a borehole in a medium is provided. The method may include providing a drill bit, where the drill bit may include a drill head and a plurality of gauge pads. The method may also include rotating the drill head at a first rotational speed, and rotating the plurality of gauge pads at a second rotational speed.

In another embodiment of the invention, another drill bit system for a drilling assembly is disclosed. The drill bit system may include a chassis, a head, and a first plurality of gauge pads. The chassis may be configured to be operably coupled with a first rotational motion source. The head may include a first plurality of cutters coupled with an end of the head, and the head may be rotatably coupled with chassis. The head may be configured to be operably coupled with a second rotational motion source. The first plurality of gauge pads may be fixedly coupled with the chassis. In some aspects, the first plurality of gauge pads may include a second plurality of cutters.

In another embodiment of the invention, another drill bit system for a drilling assembly is disclosed. The drill bit system may include a chassis, a head, and a first plurality of gauge pads. The chassis may be configured to be operably coupled with a first rotational motion source. The head may include a first plurality of cutters coupled with an end of the head, and the head may be rotatably coupled with chassis. The head may be configured to be operably coupled with a second rotational motion source. The first plurality of gauge pads may be movably coupled with the chassis. In some aspects, the first plurality of gauge pads may include a second plurality of cutters.

In another embodiment of the invention, another drill bit system for a drilling assembly is provided. The drill bit system may include a first means, a second means, a third means, a fourth means, and a fifth means. The first means may be for coupling the drill bit system with the drilling assembly. The second means may be for drilling longitudinally into a medium at a first rotational speed. The third means may be for controlling lateral movement of the second means in the medium. The fourth means may be for rotatably coupling the second means with the first means. The fifth means may be for rotating the third means at a second rotational speed.

BRIEF DESCRIPTION OF THE DRAWINGS

The present invention is described in conjunction with the appended figures.

Figure 1:
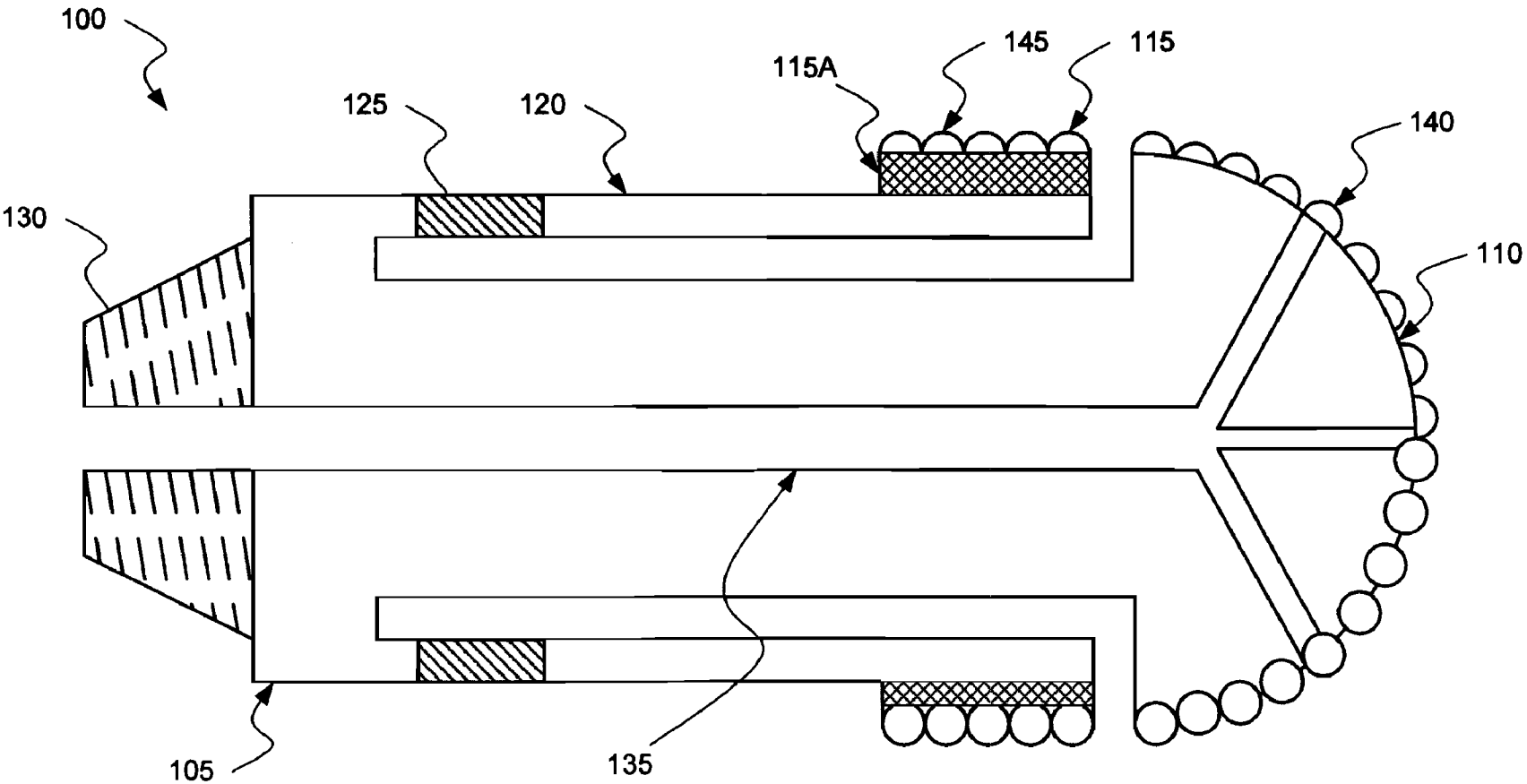
FIG. 1 is a schematic representation of one embodiment of the invention having a drill bit which includes a chassis, a head, and a first plurality of gauge pads coupled with a first sub-chassis having a compliant subsection.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, circuits, systems, networks, processes, and other elements in the invention may be shown as components in block diagram form in order not to obscure the embodiments in unnecessary detail. In other instances, well-known circuits, processes, algorithms, structures, and techniques may be shown without unnecessary detail in order to avoid obscuring the embodiments.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments. A process may correspond to a method, a function, a procedure, a subroutine, a subprogram, etc. When a process corresponds to a function, its termination corresponds to a return of the function to the calling function or the main function.

The term "machine-readable medium" includes, but is not limited to portable or fixed storage devices, optical storage devices, wireless channels and various other mediums capable of storing, containing or carrying instruction(s) and/or data. A code segment or machine-executable instructions may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

Furthermore, embodiments of the invention may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

In one embodiment of the invention, a drill bit system for a drilling assembly is provided. The drill bit system may include a chassis, a head, and a first plurality of gauge pads. The head may include a first plurality of cutters coupled with an end of the head, and the head may be coupled with chassis. The first plurality of gauge pads may be movably coupled with the chassis. In some aspects of the present invention, the first plurality of gauge pads may include a second plurality of cutters.

In some embodiments, the chassis may be constructed from a metallic compound. In these and other embodiments, any one or more of the first plurality of cutters may be a polycrystalline diamond compact ("PDC") cutter. In some embodiments, any one or more of the second plurality of cutters may also be a PDC cutter. Additionally, in any of the embodiments discussed herein, any plurality of gauge pads and/or cutters may also be presumed to also include a single gauge pad and/or cutter, but pluralities will be referred to as occurring in many typical embodiments. Furthermore, any of the embodiments discussed herein may have any of the features discussed above.

In some embodiments, the drill bit system may include a first sub-chassis. In these embodiments, the first plurality of gauge pads being movably coupled with the chassis may include the first plurality of gauge pads being fixedly coupled with the first sub-chassis, and the first sub-chassis being movably coupled with the chassis. In other embodiments with a first sub-chassis, the first plurality of gauge pads being movably coupled with the chassis may include the first plurality of gauge pads being fixedly coupled with the first sub-chassis, with the first sub-chassis including a compliant subsection. Furthermore, any of the embodiments discussed herein may have any of the features discussed above.

In other embodiments with a first sub-chassis, the first plurality of gauge pads being movably coupled with the chassis may include the first plurality of gauge pads being movably coupled with the first sub-chassis, and the first sub-chassis being movably coupled with the chassis. In some of these embodiments, the first plurality of gauge pads being movably coupled with the first sub-chassis may include the first plurality of gauge pads having a first rate of lateral compliance with the chassis, and the first sub-chassis being movably coupled with the chassis may include the first sub-chassis having a second rate of lateral compliance with the chassis. Furthermore, any of the embodiments discussed herein may have any of the features discussed above.

In some embodiments, the drill bit system may include a first sub-chassis and a second sub-chassis. A first plurality of gauge pads may be coupled with the first sub-chassis, and a second plurality of gauge pads, which comprises a third plurality of cutters, may be coupled with the second chassis. In various embodiments, each of the first plurality of gauge pads and the second plurality of gauge pads may be fixedly or movably coupled with the corresponding sub-chassis. Additionally, each of the first sub-chassis and the second sub-chassis may be fixedly or movable coupled with the chassis. Furthermore, any of the embodiments discussed herein may have any of the features discussed above.

In some embodiments, any sub-chassis referred to herein may be detachably coupleable with the chassis, and may include multiple sub-components. In this manner, sub-chassis may be replaced on a drill bit system, possibly when the performance of gauge pads thereon has degraded due to wear. Though such sub-chassis may be "detachably coupleable" with the chassis, the sub-chassis may be "fixedly" coupled with the chassis once so coupled, or "moveably" coupled with the chassis once so coupled, depending on the particular configuration. Furthermore, any of the embodiments discussed herein may have any of the features discussed above.

In some embodiments, any plurality of gauge pads or other element herein being "movably coupled" may refer to the particular gauge pads or other element having a measure of lateral compliance with the chassis or other portion of the drill bit system. In other words, upon a force acting upon the gauge pads, the gauge pads may move, at least partially laterally, rather than rigidly transferring the force to another coupled-with portion of the drill bit system or drilling assembly. "Lateral" may refer to a direction substantially orthogonal to or a direction that is directed away from, i.e., not co-linear or parallel with, a longitudinal direction that is substantially co-linear with the axis of the drill bit system. Furthermore, any of the embodiments discussed herein may have any of the features discussed above.

In some embodiments, a lateral compliance for any movable element discussed herein may be between about 1 kilonewton per millimeter and about 16 kilonewtons per millimeter. In other embodiments, a lateral compliance for any movable element discussed herein may be between about 2 kilonewtons per millimeter and about 8 kilonewtons per millimeter. In an exemplary embodiment, a lateral compliance for any movable element discussed herein may be between 4 and 6 kilo-Newtons per millimeter In yet other embodiments, a lateral compliance for any movable element discussed herein may be about 4 kilonewtons per millimeter. In some embodiments, a lateral compliance for any movable element discussed herein may be less than about 16 kilonewtons per millimeter. In other embodiments, a lateral compliance for any movable element discussed herein may be less than about 8 kilonewtons per millimeter. In an exemplary embodiment, a lateral compliance for any movable element discussed herein may be less than 6 kilo-Newtons per millimeter In other embodiments, a lateral compliance for any movable element discussed herein may be less than about 4 kilonewtons per millimeter. In yet other embodiments, a lateral compliance for any movable element discussed herein may be less than about 2 or even 1 kilonewtons per millimeter. Merely by way of example, a 4 kilonewton per millimeter compliance means that for about every 4 kilonewtons of force applied to a movable element, that element may move about 1 millimeter with reference to some other element. Furthermore, any of the embodiments discussed herein may have any of the features discussed above.

In some embodiments, directionally controlling the absolute lateral directional compliance of gauge pads in various embodiments of the invention while drilling may allow for directional drilling in an absolute lateral direction related to the controlled absolute lateral direction. In some embodiments, a side-tracking of between 1 and 10 millimeters per meter drilled may be realized. In an exemplary embodiment, a side-tracking of greater than 10 millimeters per meter drilled may be realized. Furthermore, any of the embodiments discussed herein may have any of the features discussed above.

In some embodiments, the drill bit system may include a second plurality of gauge pads. In these embodiments, the second plurality of gauge pads may include a third plurality of cutters, and may be fixedly coupled with the chassis. Furthermore, any of the embodiments discussed herein may have any of the features discussed above.

In other embodiments, where the drill bit system includes a second plurality of gauge pads, the second plurality of gauge pads may be movably coupled with the chassis. In some of these embodiments, the first plurality of gauge pads may have a first rate of lateral compliance with the chassis, while the second plurality of gauge pads may have a second, different rate of lateral compliance with the chassis. Furthermore, any of the embodiments discussed herein may have any of the features discussed above.

Merely, by way of example, in some embodiments, gauge pads closer to the head of the drill bit system may have a higher rate of lateral compliance with the chassis than gauge pads farther away from the head of the drill bit system. In other embodiments, the reverse may be true, with gauge pads closer to the head of the drill bit system having a lower rate of lateral compliance with the chassis than gauge pads farther away from the head of the drill bit system. And as discussed above, even though plurality of gauge pads are referred to, in some embodiments, individual gauge pads within any plurality of gauge pads may be independently movably coupled and have differing rates of lateral compliance. Furthermore, any of the embodiments discussed herein may have any of the features discussed above.

In another embodiment of the invention, another drill bit system for a drilling assembly is provided. The drill bit system may include a first means, a second means, a third means, and a fourth means.

In some embodiments, the first means may be for coupling the drill bit system with the drilling assembly. Merely by way of example, the first means may include a chassis or any other component discussed herein, or otherwise known in the art, now or in the future, for coupling the drill bit system with the drilling assembly.

In some embodiments, the second means may be for drilling longitudinally into a medium. Merely by way of example, the second means may include a head or any other component discussed herein, or otherwise known in the art, now or in the future, for drilling longitudinally into a medium.

In some embodiments, the third means may be for controlling lateral movement of the second means in the medium. Merely by way of example, the third means may include a plurality of gauge pads or any other component discussed herein, or otherwise known in the art, now or in the future, for controlling lateral movement of the second means in the medium. Further by way of example, the third means may include a plurality of gauge pads movably or fixedly coupled with the second means.

In some embodiments, the fourth means for movably coupling the third means with the second means. Merely by way of example, the fourth means may include a compliant coupling between the third means and the second means or any other component discussed herein, or otherwise known in the art, now or in the future, for coupling the third means with the second means.

In some embodiment the drill bit system may further include a fifth means for controlling lateral movement of the second means in the medium. Merely by way of example, the fifth means may include a steerable bit system coupled with the second means or any other component discussed herein, or otherwise known in the art, now or in the future, for controlling lateral movement of the second means in the medium.

In another embodiment of the invention, another drill bit system for a drilling assembly is provided. The drill bit system may include a chassis, a head, and a first plurality of gauge pads. The head may include a first plurality of cutters coupled with an end of the head, and the head may be movably coupled with chassis. The first plurality of gauge pads may be fixedly coupled with the chassis. In certain aspects of the present invention, the first plurality of gauge pads may include a second plurality of cutters.

In some embodiments, the drill bit system may also include an off-set mechanism configured to move the head relative to the chassis. In some of these embodiments, the off-set mechanism may be configured to move the head relative to the chassis in a substantially constant lateral direction while the drill bit system rotates about its axis. In some embodiments, the off-set mechanism may include, merely by way of example, a cam system, a hydraulic actuator system, a drilling fluid (mud) powered actuator system, a piezo-electric actuator system, an electro rheological actuator system, a magneto rheological actuator system, and electro active polymer actuator system, and/or a ball screw actuator system. In some embodiments, the off-set mechanism may be configured to provide a displacement of up to about 0.1 millimeters. In other embodiments, the off-set mechanism may be configured to provide a displacement of up to about 0.2 millimeters. Furthermore, any of the embodiments discussed herein may have any of the features discussed above.

In some embodiments, the drill bit system may also include a flexible coupling. In some of these embodiments, the head being movably coupled with the chassis may include the head being coupled with the flexible coupling, and the flexible coupling being coupled with the chassis. Furthermore, any of the embodiments discussed herein may have any of the features discussed above.

In some embodiments, the drill bit system may also include a joint for pivotally coupling the head with the chassis. Merely by way of example, the joint may be a universal joint configured to allow for a wide degree of freedom of movement for the head. Furthermore, any of the embodiments discussed herein may have any of the features discussed above.

In another embodiment of the invention, another drill bit system for a drilling assembly is provided. The drill bit system may include a chassis, a head, and a first plurality of gauge pads. The head may include a first plurality of cutters coupled with an end of the head, and the head may be movably coupled with chassis. The first plurality of gauge pads may include a second plurality of cutters, and the first plurality of gauge pads may be movably coupled with the chassis.

In these embodiments, features discussed above related to sub-chassis, movably and fixedly coupled, and/or pluralities of gauge pads, movably and/or fixedly coupled, may be included, either in-whole or in-part. These embodiments may also include off-set mechanisms, flexible couplings, and/or joints as discussed above.

In another embodiment of the invention, another drill bit system for a drilling assembly is provided. The drill bit system may include a first means, a second means, a third means, and a fourth means.

In some embodiments, the first means may be for coupling the drill bit system with the drilling assembly. Merely by way of example, the first means may include a chassis or any other component discussed herein, or otherwise known in the art, now or in the future, for coupling the drill bit system with the drilling assembly.

In some embodiments, the second means may be for drilling longitudinally into a medium. Merely by way of example, the second means may include a head or any other component discussed herein, or otherwise known in the art, now or in the future, for drilling longitudinally into a medium.

In some embodiments, the third means may be for controlling lateral movement of the second means in the medium. Merely by way of example, the third means may include a plurality of gauge pads or any other component discussed herein, or otherwise known in the art, now or in the future, for controlling lateral movement of the second means in the medium. Further by way of example, the third means may include a plurality of gauge pads movably or fixedly coupled with the second means.

In some embodiments, the fourth means may be for movably coupling the second means with the first means. Merely by way of example, the fourth means may include a compliant coupling between the second means and the first means or any other component discussed herein, or otherwise known in the art, now or in the future, for movably coupling the second means with the first means.

In some embodiments, the drill bit system may also include a fifth means for controlling lateral movement of the second means in the medium. Merely by way of example, the fifth means may include an off-set mechanism configured to move the second means relative to the first means or any other component discussed herein, or otherwise known in the art, now or in the future, for controlling lateral movement of the second means in the medium.

In another embodiment of the invention, another drill bit system for a drilling assembly is disclosed. The drill bit system may include a chassis, a head, and a first plurality of gauge pads. The chassis may be configured to be operably coupled with a first rotational motion source. The head may include a first plurality of cutters coupled with an end of the head, and the head may be rotatably coupled with chassis. The head may be configured to be operably coupled with a second rotational motion source. The first plurality of gauge pads may be fixedly coupled with the chassis. In certain aspects, the first plurality of gauge pads may include a second plurality of cutters.

In some embodiments, the first rotational motion source may include an above-ground rotational motion source such as a topdrive system or a rotary table system. In these and other embodiments, the second rotational motion source may include a mud motor located in a bottom hole assembly. Furthermore, any of the embodiments discussed herein may have any of the features discussed above.

In some embodiments, the first rotational motion source may have a first rotational speed, and the second rotational motion source may have a second rotation speed. In other embodiments, the first rotational motion source and the second rotational motion source may have the same speed. In some embodiments, each of the first rotational speed and the second rotational speed may be either fixed or variable, discretely variable, and/or continuously variable. Furthermore, any of the embodiments discussed herein may have any of the features discussed above.

In some embodiments, the drill bit system may also include a bias system configured to transfer a vibration of the head to the chassis in substantially one direction. In some of these embodiments, the bias system may also be configured to transfer the vibration of the head in a substantially constant lateral direction while the head rotates about its axis. In some embodiments, merely by way of example, the bias system may include a cam system, a hydraulic actuator system, a drilling fluid (mud) powered actuator system, a piezo-electric actuator system, an electro rheological actuator system, a magneto rheological actuator system, and electro active polymer actuator system, and/or a ball screw actuator system. In some embodiments, the bias system may be configured to provide a displacement of up to about 0.1 millimeters. In other embodiments, the bias system may be configured to provide a displacement of up to about 0.2 millimeters. In yet other embodiments of the present invention, the bias system may be configured to provide a displacement of between about 0.2 millimeters and 1 millimeters. In other embodiments, the bias system may be configured to provide a displacement of the order of millimeters. Furthermore, any of the embodiments discussed herein may have any of the features discussed above.

In some embodiments, the drill bit system may also include a bearing. In some of these embodiments, the head being rotatably coupled with the chassis may include the h head being operably coupled with the bearing, and the bearing being operably coupled with the chassis. Bearing is understood, as is known in the art, to include bushings and other means for rotatably coupling two components and allowing for smooth rotational motion between the two components. Furthermore, any of the embodiments discussed herein may have any of the features discussed above.

In some of the embodiments which include a bearing, the bearing may include a bias system configured to transfer a vibration of the head to the chassis in substantially one direction. In these embodiments, the bias system may be configures to transfer the vibration of the head in a substantially constant lateral direction while the head rotates about its axis. Furthermore, any of the embodiments discussed herein may have any of the features discussed above.

In another embodiment of the invention, another drill bit system for a drilling assembly is disclosed. The drill bit system may include a chassis, a head, and a first plurality of gauge pads. The chassis may be configured to be operably coupled with a first rotational motion source. The head may include a first plurality of cutters coupled with an end of the head, and the head may be rotatably coupled with chassis. The head may be configured to be operably coupled with a second rotational motion source. The first plurality of gauge pads may be movably coupled with the chassis. In some embodiments of the present invention, the first plurality of gauge pads may include a second plurality of cutters.

In these embodiments, features discussed above related to sub-chassis, movably and fixedly coupled, and/or pluralities of gauge pads, movably and/or fixedly coupled, may be included, either in-whole or in-part. These embodiments may also include bias systems and/or bearings as discussed above.

In another embodiment of the invention, another drill bit system for a drilling assembly is provided. The drill bit system may include a first means, a second means, a third means, a fourth means, and a fifth means.

In some embodiments, the first means may be for coupling the drill bit system with the drilling assembly. Merely by way of example, the first means may include a chassis or any other component discussed herein, or otherwise known in the art, now or in the future, for coupling the drill bit system with the drilling assembly.

In some embodiments, the second means may be for drilling longitudinally into a medium at a first rotational speed. Merely by way of example, the second means may include a head or any other component discussed herein, or otherwise known in the art, now or in the future, for drilling longitudinally into a medium at a first rotational speed.

In some embodiments, the third means may be for controlling lateral movement of the second means in the medium. Merely by way of example, the third means may include a plurality of gauge pads or any other component discussed herein, or otherwise known in the art, now or in the future, for controlling lateral movement of the second means in the medium.

In some embodiments, the fourth means may be for rotatably coupling the second means with the first means. Merely by way of example, the fourth means may include a bearing or any other component discussed herein, or otherwise known in the art, now or in the future, for rotatably coupling the second means with the first means.

In some embodiments, the fifth means may be for rotating the third means at a second rotational speed. Merely by way of example, the fifth means may include the first means, and the first means may include a rotatable chassis. Additionally, the fifth means may include any other component discussed herein, or otherwise known in the art, now or in the future, for rotating the third means at a second rotational speed.

In some embodiments, the drill bit system may also include a sixth means for transferring lateral vibration of the second means to the third means. Merely by way of example, the sixth means may include a bias system or any other component discussed herein, or otherwise known in the art, now or in the future, for transferring lateral vibration of the second means to the third means.

Turning now to FIG. 1, a schematic representation of one embodiment of the invention having a drill bit 100 which includes a chassis 105, a head 110, and a first plurality of gauge pads 115 coupled with a first sub-chassis 120 having a compliant subsection 125 is shown.

Chassis 105 includes a threaded pin 130 for coupling drill bit 100 with a bottom hole assembly or other drilling assembly. Chassis 105 and head 110 also have drilling fluid passages 135 defined therein. Head 110 includes a first plurality of cutters 140. First plurality of gauge pads 115 may include a second plurality of cutters 145.

In the embodiment shown in FIG. 1, first sub-chassis 120 has a compliant subsection 125, and is fixedly coupled with chassis 105. Compliant subsection 125 allows first plurality of gauge pads 115 to have a certain amount of compliance relative to chassis 105 and head 110. Thus, as drill bit 100 rotates through a medium, a force acting on first plurality of gauge pads 115 may cause at least a portion first plurality of gauge pads 115 to deflect inward toward the chassis. This will cause more force from the interaction of drill bit 100 and the medium to be applied to first plurality of cutters 140 on head 110, rather than on first plurality of gauge pads 115.

In FIG. 1, the plurality of gauge pads 115 are depicted as hemispherical in shape, however, some embodiments of the present invention, the plurality of gauge pads 115 may comprise a gauge pad 115A. The gauge pad 115A may comprise any shape, including a single solid ridge, a plurality of ridges disposed around the sub-chassis 120, a tapered ridge, a plurality of tapered ridges disposed around the sub-chassis 120, a disc, a cylinder, a protrusion, an element coupled with the sub-chassis 120, a laterally extended portion of the sub-chassis 120 and/or the like. The gauge pad 115A may extend laterally outward from the sub-chassis 120 thereby increasing the gauge of the sub-chassis 120 at the location of the gauge pad 115A.

In some embodiments, the first sub-chassis 120 may comprise a plurality of sub-chasses coupled with the chassis 105 with each of the plurality of sub-chasses in turn being coupled with one or more gauge pads. In such embodiments, there may be a plurality of compliant elements or the like coupled with the plurality of the sub-chasses. In some embodiments of the present invention, one or more of the plurality of gauge pads 115 may be configured to engage a sidewall of a borehole being drilled by the drilling system of FIG. 1 during a drilling process.

In some aspects of the present invention, one or more of the plurality of gauge pads 115 may extend laterally from the sub-chassis 120 to the gauge of the drill bit 100. In some aspects, one or more of the plurality of gauge pads 115 may extend from the first sub-chassis 120 to less than the gauge of the drill bit 100. In some of the previous aspects of the present invention, one or more of the plurality of gauge pads may extend to a range of less than 1-10 millimeters of the gauge of the drill bit 100. In some aspects, one or more of the plurality of gauge pads 115 may extend beyond the gauge of the drill bit 100. In some of the previous aspects of the present invention, one or more of the plurality of gauge pads may extend beyond the gauge of the drill bit by between 1 to 10 millimeters and in other aspects by more than 10 millimeters.

In this and all other embodiments discussed herein, the physical characteristics of the material employed for a given sub-chassis (for example, Young's modulus of elasticity), as well as the cantilever construction/coupling of the sub-chassis' may also provide a certain amount of compliance for a plurality of gauge pads. However, in other embodiments, fixedly coupled sub-chassis may also be rigid and non-compliant.

Figure 2:
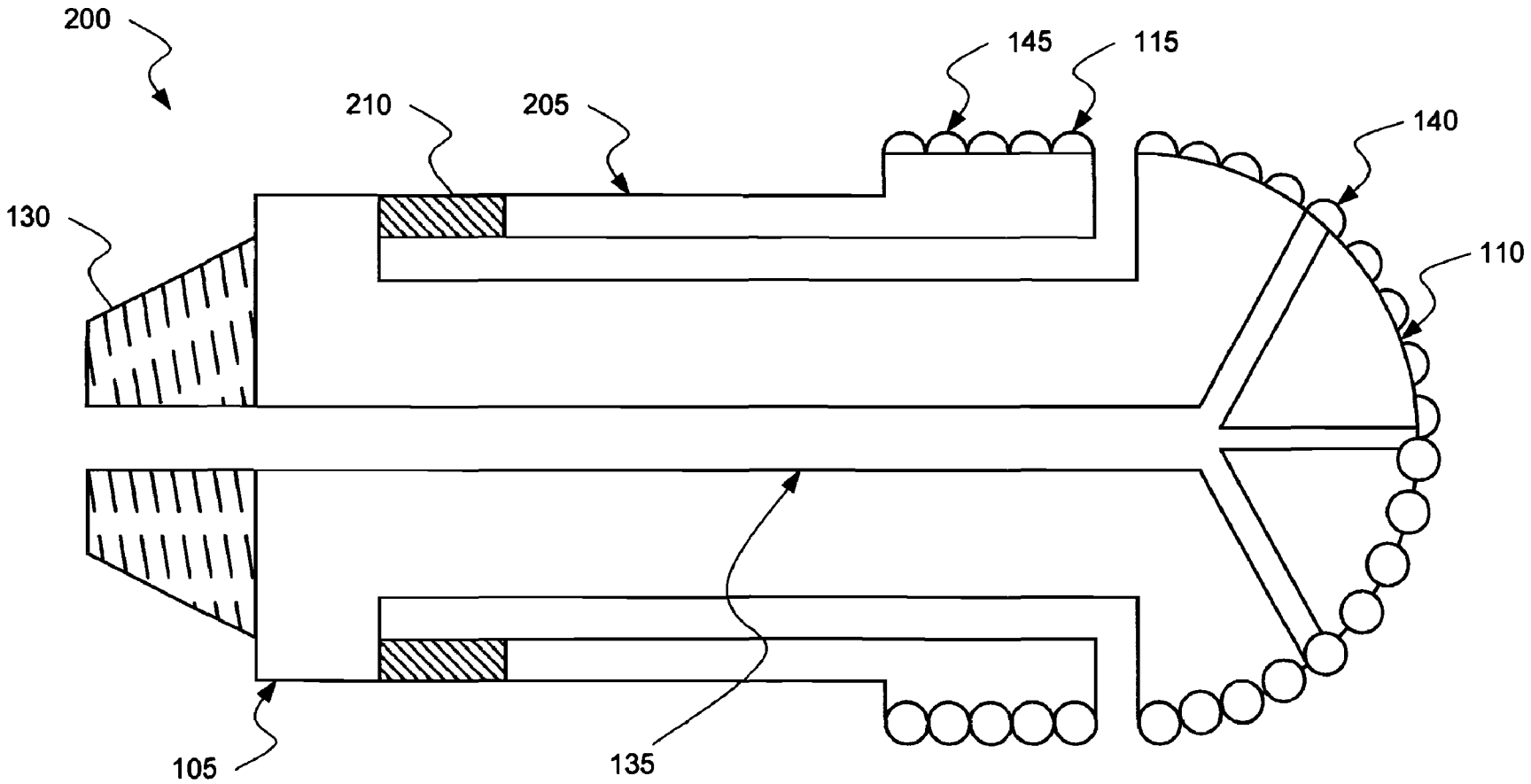
FIG. 2 is a schematic representation of another drill bit embodiment of the invention, similar to that shown in FIG. 1, except that the first sub-chassis does not have a complaint subsection, but instead is movably coupled with the chassis.

FIG. 2 shows a schematic representation of another drill bit 200 embodiment of the invention, similar to that shown in FIG. 1, except that first sub-chassis 205 does not have a complaint subsection, but instead is movably coupled with chassis 105 via compliant coupling 210. Compliant coupling 210 may provide at least a similar amount of compliant relative to chassis 105 and head 110 for first plurality of gauge pads 115 as in FIG. 1.

Figure 3:
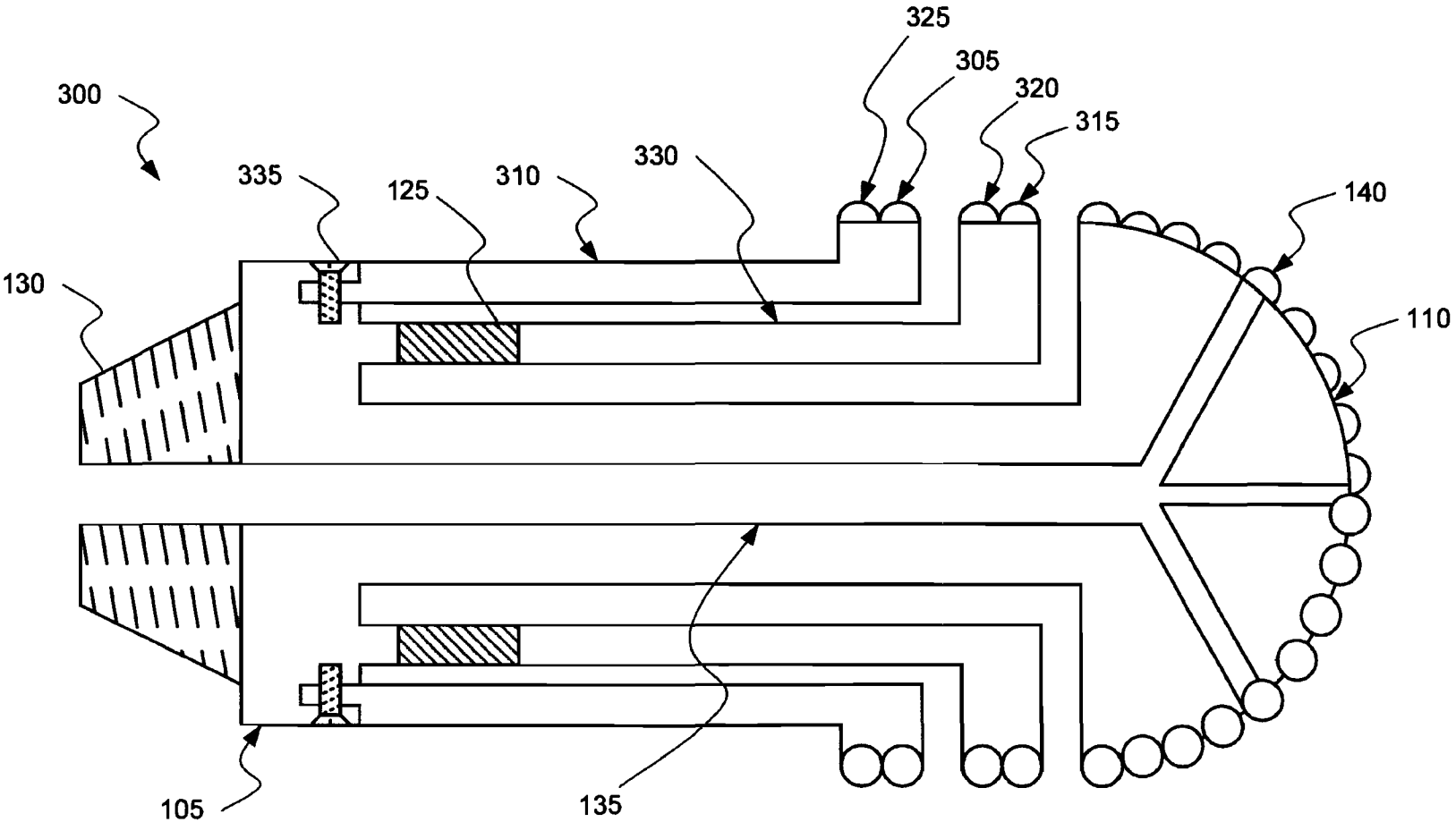
FIG. 3 is a schematic representation of another drill bit embodiment of the invention, similar to that shown in FIG. 1, except that the drill bit includes a second plurality of gauge pads coupled with a second sub-chassis fixedly coupled with the chassis, and the second sub-chassis is detachably coupled with the chassis.

FIG. 3 shows a schematic representation of another drill bit 300 embodiment of the invention, similar to that shown in FIG. 1, except that drill bit 300 includes a second plurality of gauge pads 305 coupled with a second sub-chassis 310 fixedly coupled with chassis 105, and second sub-chassis 310 is detachably coupled with chassis 105.

The first plurality of gauge pads 315 may still include a second plurality of cutters 320. Meanwhile, second plurality of gauge pads 305 may include a third plurality of cutters 325. First plurality of gauge pads 315 are still coupled with a first sub-chassis 330, which includes compliant subsection 125.

Second sub-chassis 310 is coupled with chassis 105 via detachable coupling mechanism 335, exemplarily shown here as a countersunk screw coupling. The embodiment shown in FIG. 3 is an example of how a sub-chassis may be fixedly coupled with chassis 105, but may also be "detachably coupled." Second sub-chassis 310 may be comprised of multiple subcomponents to allow for second sub-chassis to be detachably coupled with chassis 105.

Figure 4:
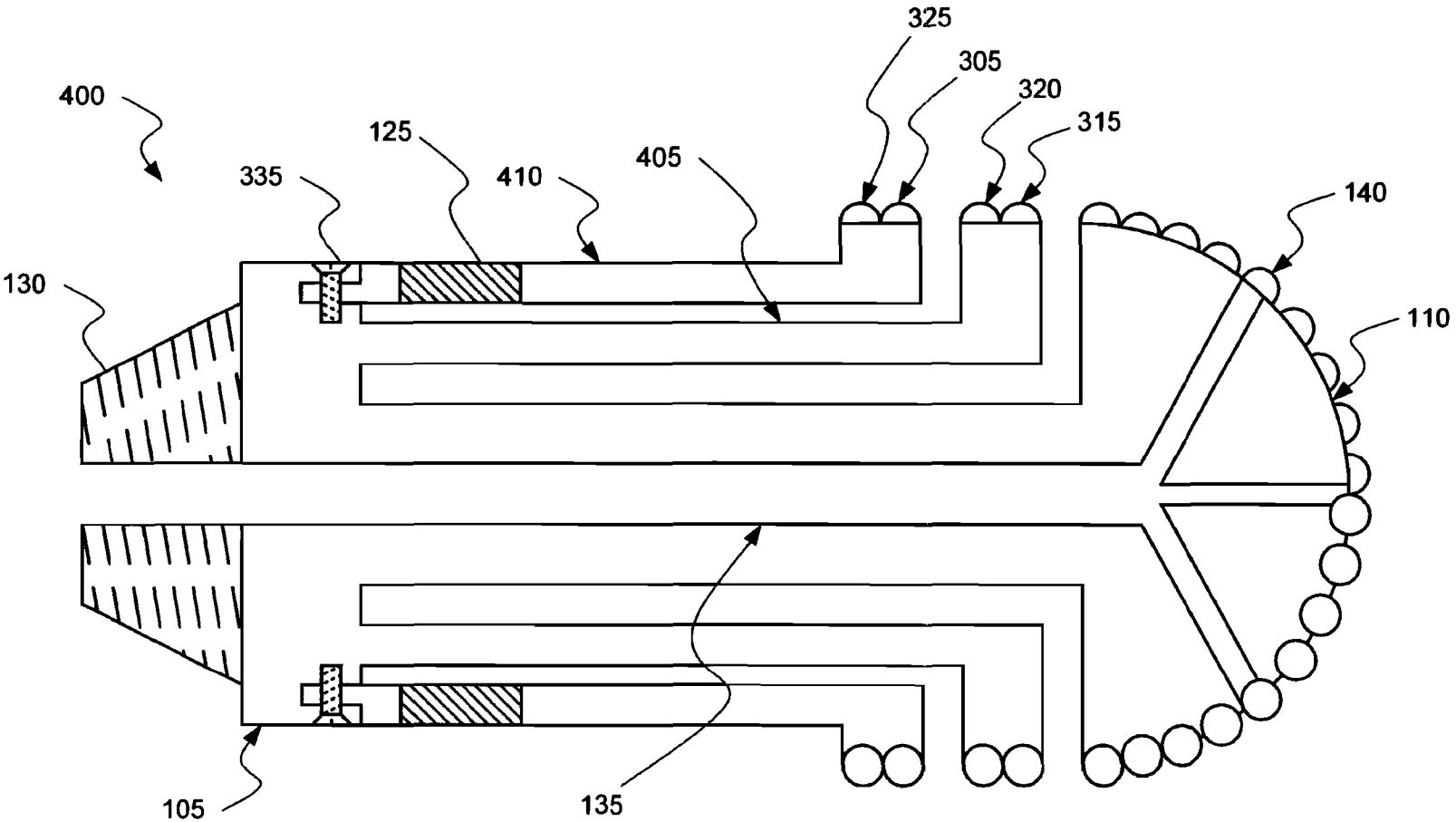
FIG. 4 is a schematic representation of another drill bit embodiment of the invention, similar to that shown in FIG. 3, except that the sub-chassis which includes the compliant subsection has changed.

FIG. 4 shows a schematic representation of another drill bit 400 embodiment of the invention, similar to that shown in FIG. 3, except that the sub-chassis which includes compliant subsection 125 has changed. In this embodiment, first sub-chassis 405 is fixedly and undetachably coupled with chassis 105, while second sub-chassis 410 is fixedly and detachably coupled with chassis 105 via detachable coupling mechanism 335.

Figure 5:
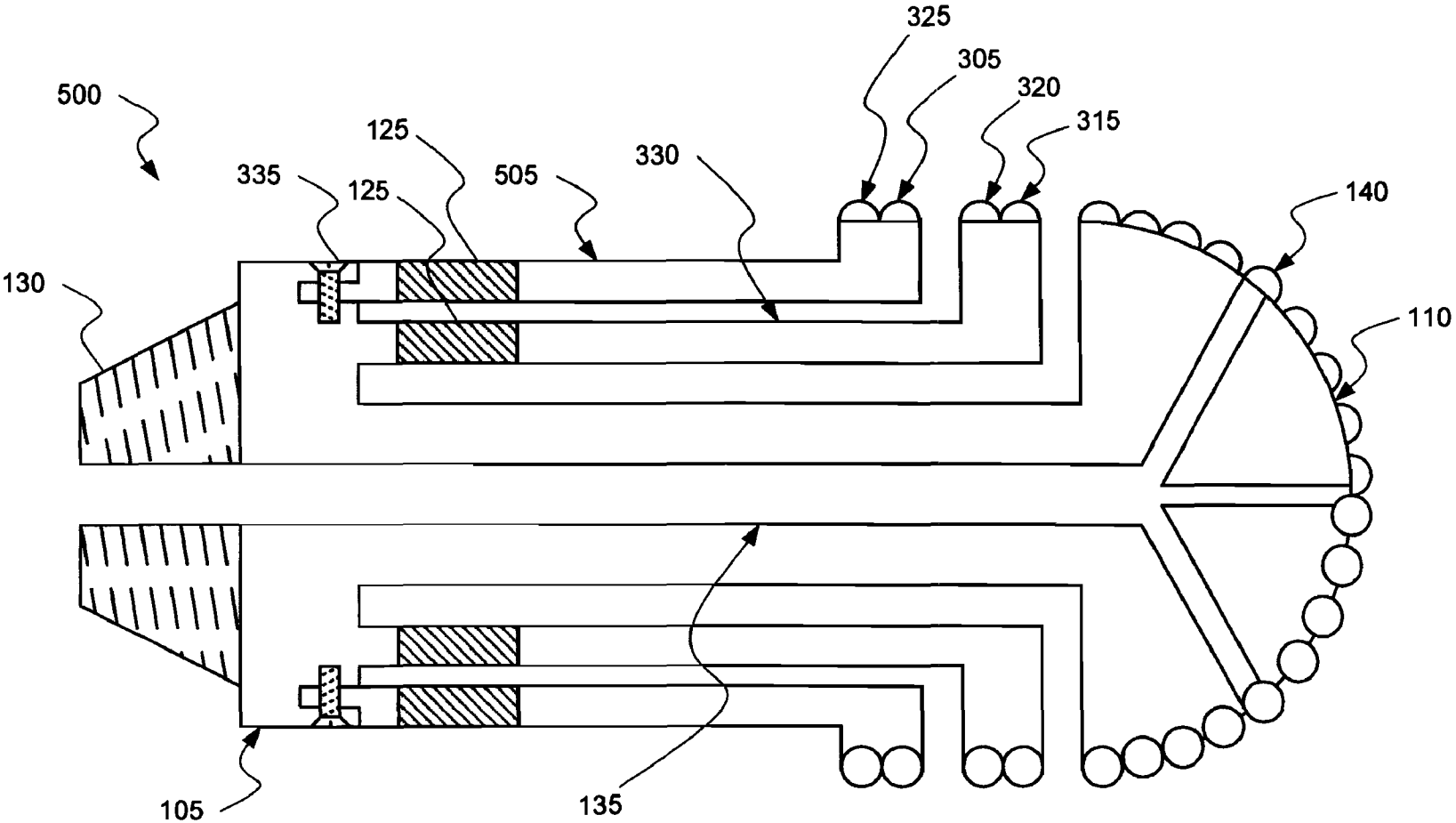
FIG. 5 is a schematic representation of another drill bit embodiment of the invention, similar to that shown in FIG. 3, except that both sub-chassis include a compliant subsection.

FIG. 5 shows a schematic representation of another drill bit 500 embodiment of the invention, similar to that shown in FIG. 3, except that both sub-chassis include a compliant subsection 125. Both first sub-chassis 330 and second sub-chassis 505 include a compliant subsection 125. Likewise second sub-chassis remains detachably coupled with chassis 105 via detachable coupling mechanism 335.

Figure 6:
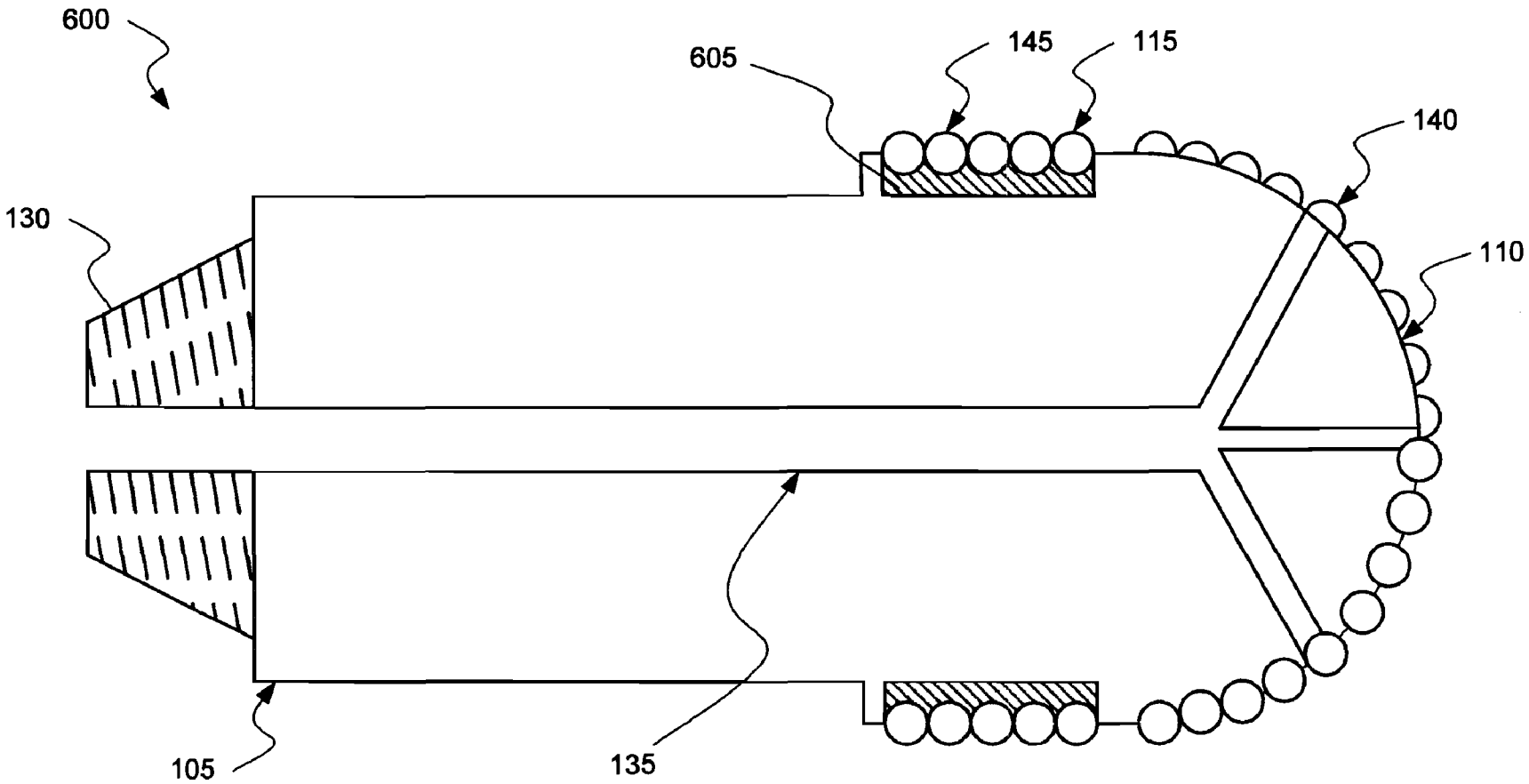
FIG. 6 is a schematic representation of another embodiment of the invention having a drill bit which includes a chassis, a head, and a first plurality of gauge pads movably coupled with the chassis.

FIG. 6 shows a schematic representation of another embodiment of the invention having a drill bit 600 which includes a chassis 105, a head 110, and a first plurality of gauge pads 115 movably coupled with chassis 105. In this embodiment, a compliant medium 605 provides the lateral compliance for first plurality of gauge pads 115.

Figure 7:
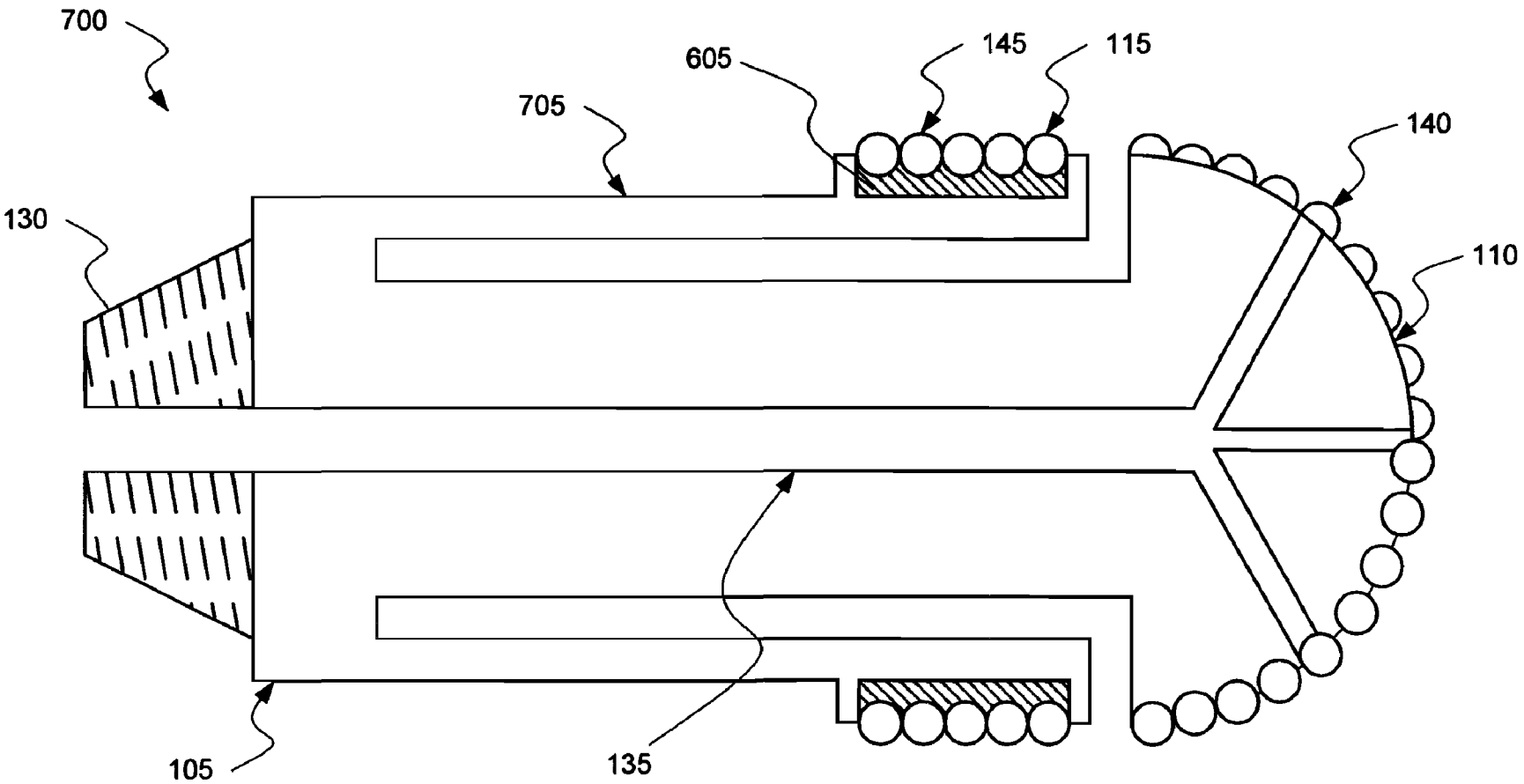
FIG. 7 is a schematic representation of another embodiment of the invention having a drill bit which includes a chassis, a head, and a first plurality of gauge pads movably coupled with a first sub-chassis fixedly coupled with the chassis.

FIG. 7 shows a schematic representation of another embodiment of the invention having a drill bit 700 which includes a chassis 105, a head 110, and a first plurality of gauge pads 115 movably coupled with a first sub-chassis 705 which is fixedly coupled with chassis 105. In this embodiment, compliant medium 605, as well as possibly the physical properties and cantilever nature of first sub-chassis 705 may provide the lateral compliance for first plurality of gauge pads 115.

Figure 8:
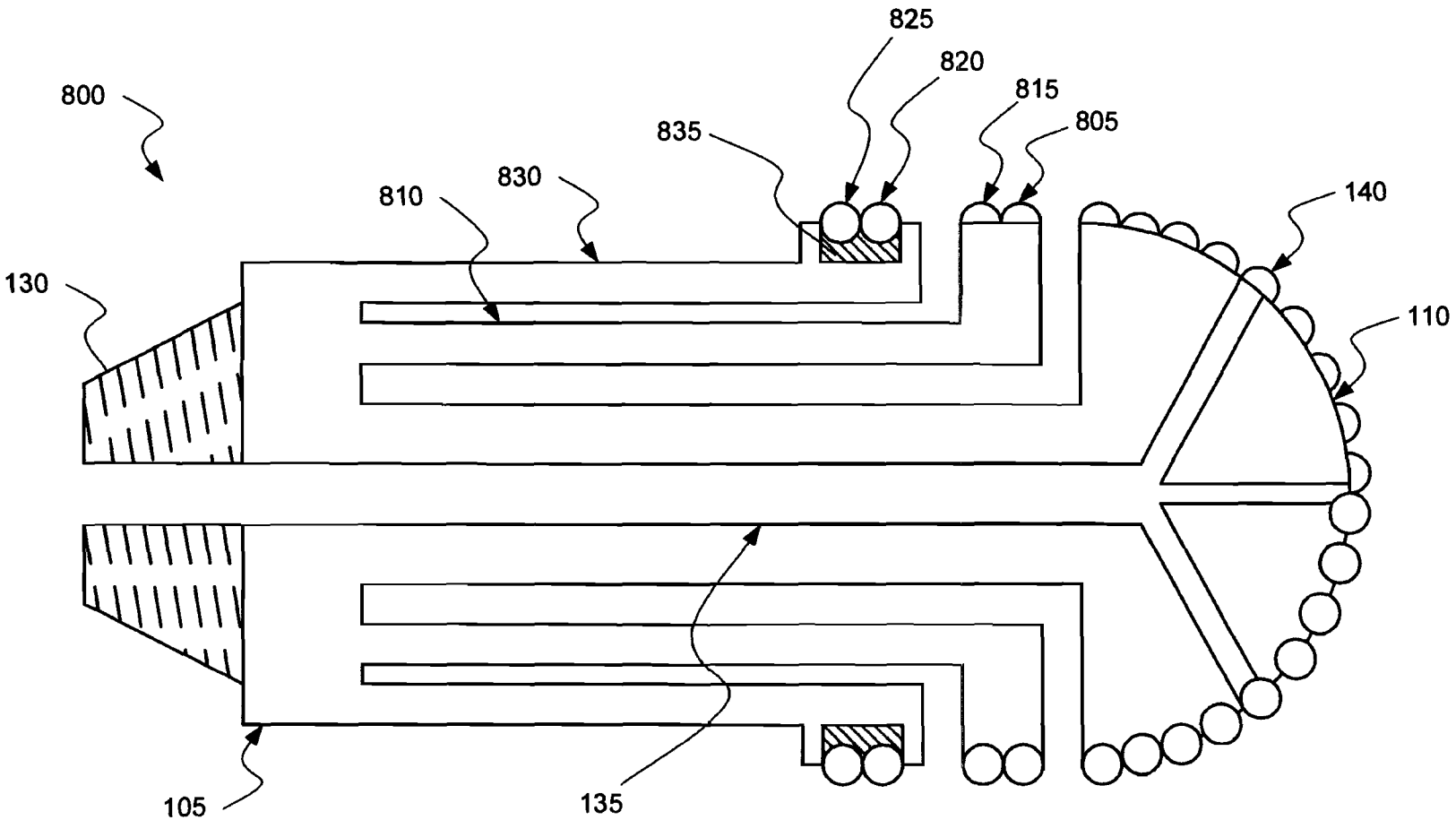
FIG. 8 is a schematic representation of another embodiment of the invention, similar to that shown in FIG. 7, except that the drill bit includes a second plurality of gauge pads coupled with a second sub-chassis fixedly coupled with the chassis.

FIG. 8 shows a schematic representation of another embodiment of the invention, similar to that shown in FIG. 7, except that the drill bit 800 includes a second plurality of gauge pads 805 coupled with a second sub-chassis 810 fixedly coupled with the chassis 105. Second plurality of gauge pads 805 may include a third plurality of cutters 815, while first plurality of gauge pads 820 may include a second plurality of cutters 825.

First plurality of gauge pads 820 are coupled with chassis 105 via fixedly coupled first sub-chassis 830 and compliant medium 835. In this embodiment, compliant medium 835, as well as possibly the physical properties and cantilever nature of first sub-chassis 830 may provide the lateral compliance for first plurality of gauge pads 820.

Figure 9:
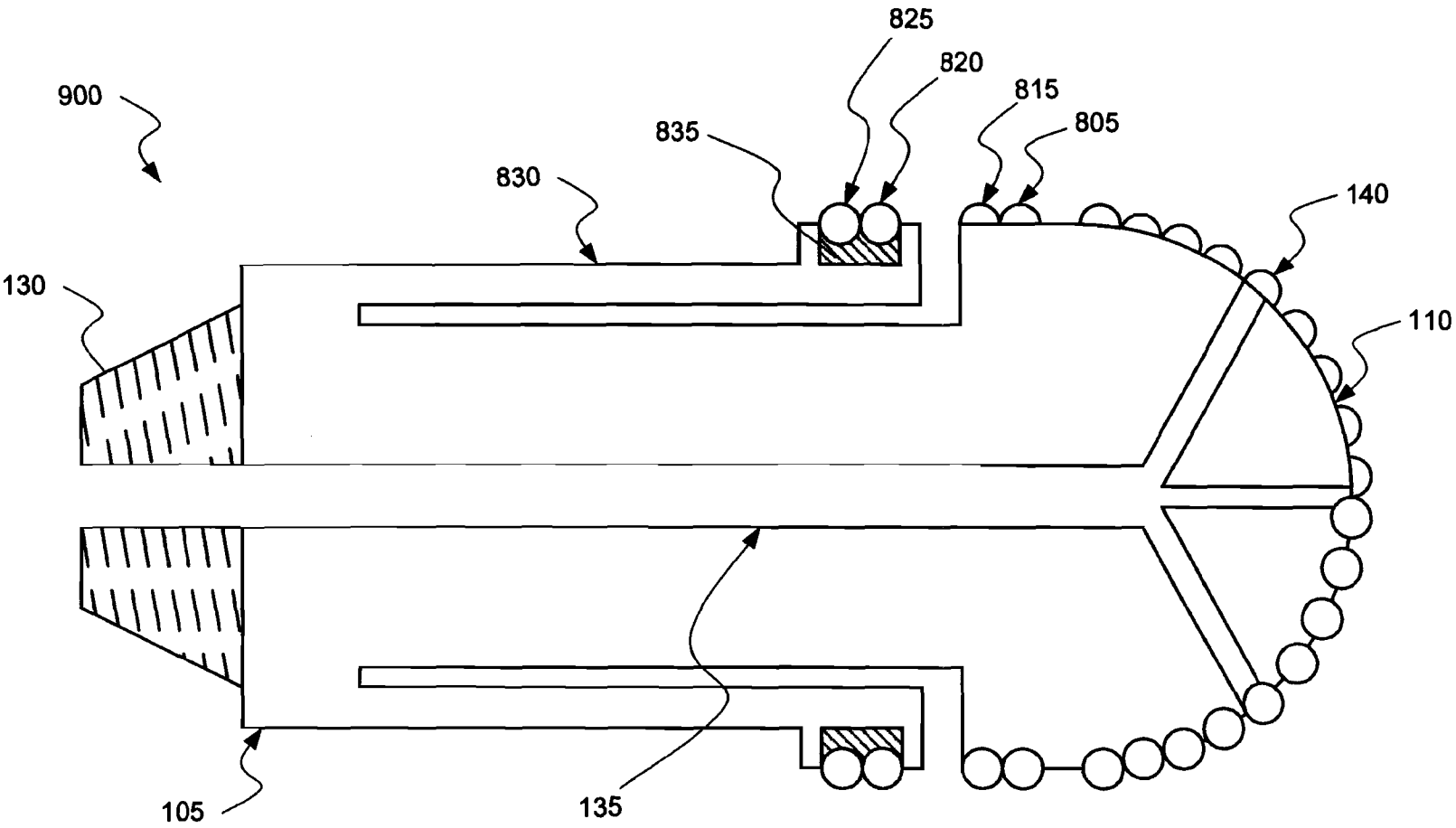
FIG. 9 is a schematic representation of another embodiment of the invention, similar to that shown in FIG. 7, except that the drill bit includes a second plurality of gauge pads fixedly coupled with the chassis.

FIG. 9 shows a schematic representation of another embodiment of the invention, similar to that shown in FIG. 7, except that the drill bit 900 has second plurality of gauge pads 805 fixedly coupled with chassis 105. In this embodiment, any lateral compliance provided by second sub-chassis 810 in the embodiment shown in FIG. 8 may be reduced and/or eliminated.

Figure 10:
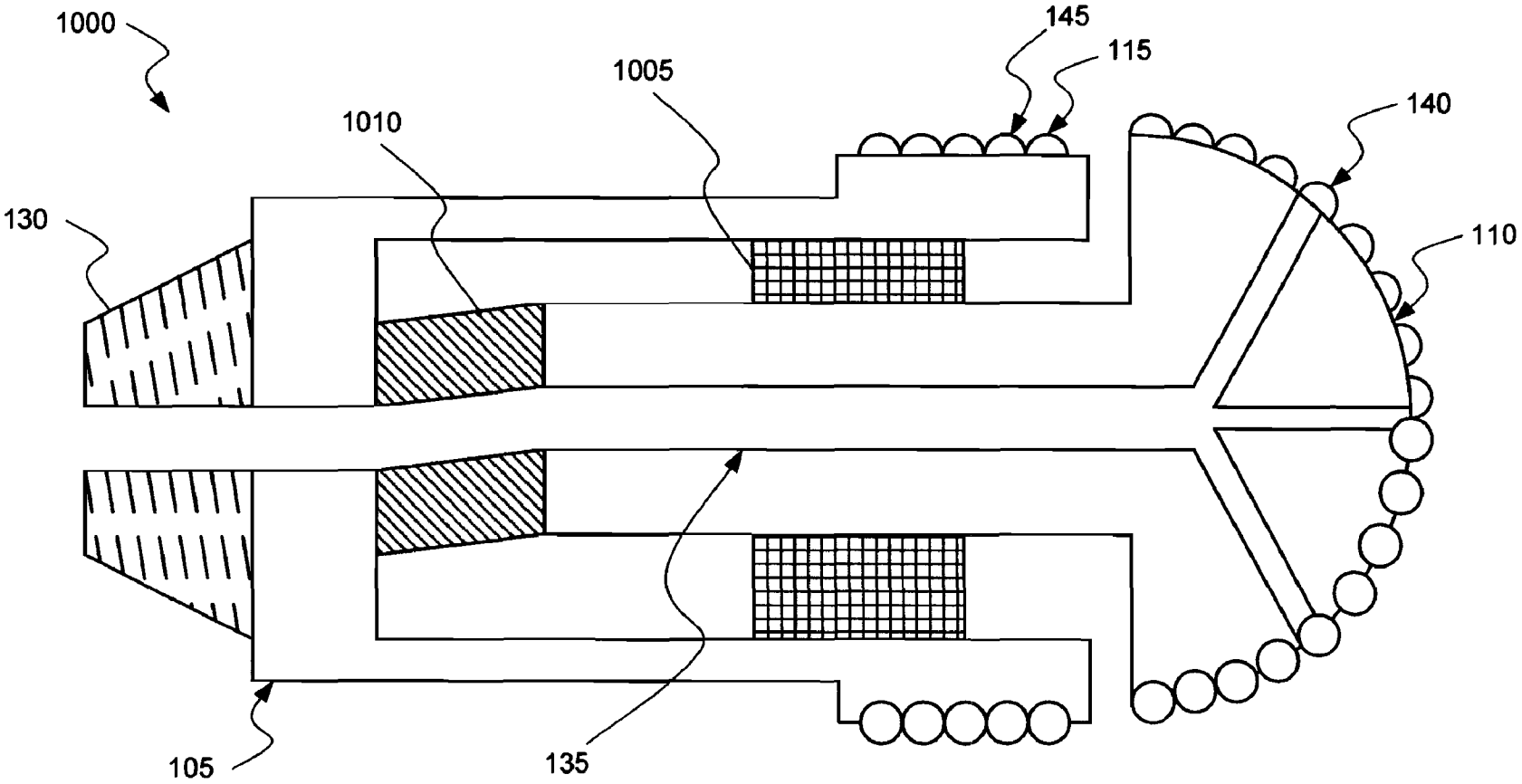
FIG. 10 is a schematic representation of another embodiment of the invention having a drill bit which includes a chassis, a head, and a first plurality of gauge pads fixedly coupled with the chassis, and an off-set mechanism, where the head is movably coupled with the chassis, and is movable via actuation of the off-set mechanism.

FIG. 10 shows a schematic representation of another embodiment of the invention having a drill bit 1000 which includes a chassis 105, a head 110, and a first plurality of gauge pads 115 fixedly coupled with chassis 105, and an off-set mechanism 1005, where head 110 is movably coupled with the chassis via flexible coupling 1010, and is movable via actuation of off-set mechanism 1005. Selective and/or progressive activation of off-set mechanism 1005 during specific discrete points or ranges of rotation of drill bit 1000 may allow drill bit 1000 to be steered through the medium and create curved direction cavities.

Figure 11:
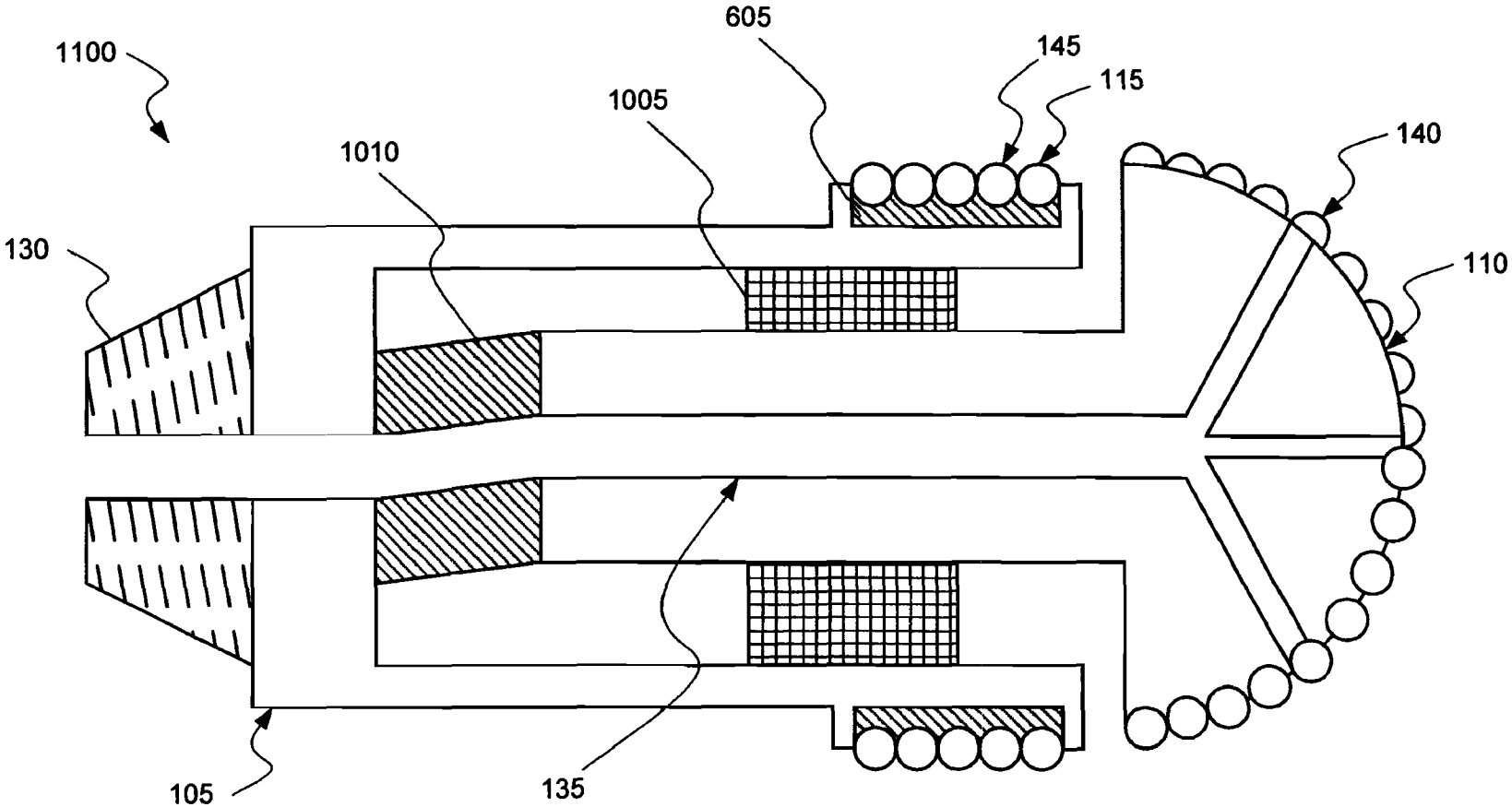
FIG. 11 is a schematic representation of another drill bit embodiment of the invention, similar to that shown in FIG. 10, except that the first plurality of gauge pads are movably coupled with the chassis.

FIG. 11 shows a schematic representation of another drill bit 1100 embodiment of the invention, similar to that shown in FIG. 10, except that first plurality of gauge pads 115 are movably coupled with chassis 105 via compliant medium 605.

Figure 12:
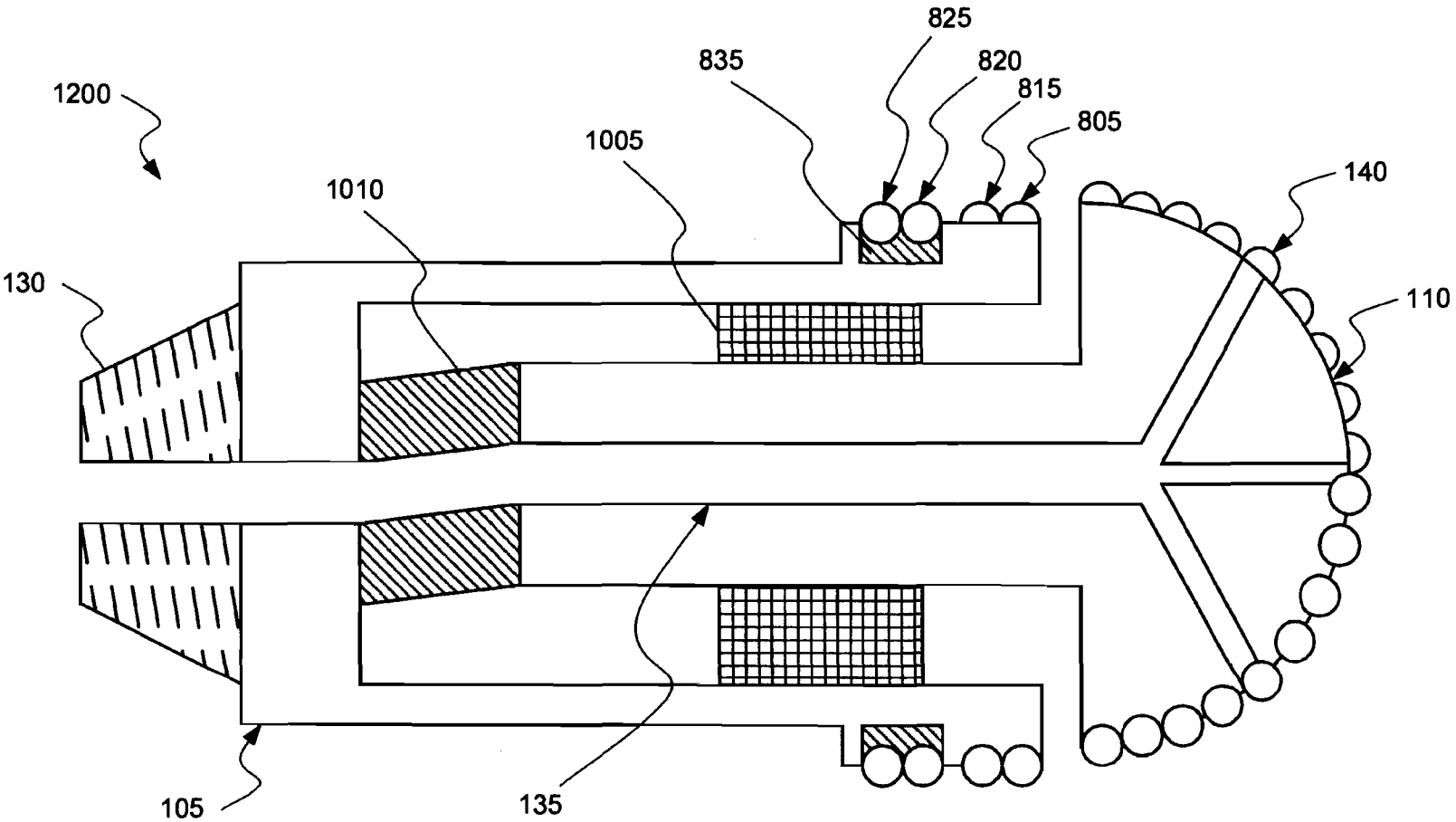
FIG. 12 is a schematic representation of another embodiment of the invention, similar to that shown in FIG. 11, except that the drill bit includes a second plurality of gauge pads fixedly coupled with the chassis.

FIG. 12 shows a schematic representation of another embodiment of the invention, similar to that shown in FIG. 11, except that the drill bit 1200 includes a second plurality of gauge pads 805 fixedly coupled with chassis 105.

Figure 13:
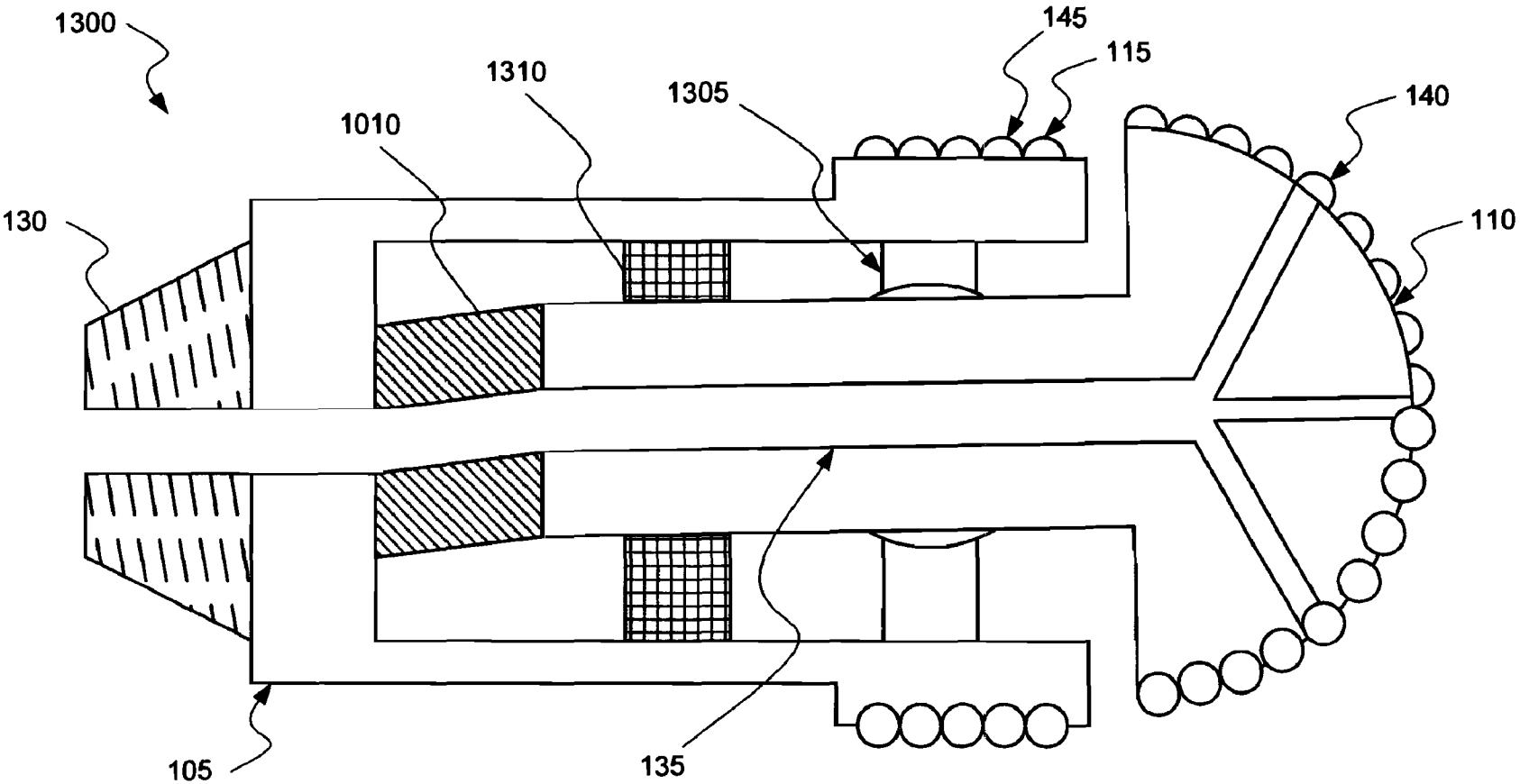
FIG. 13 is a schematic representation of another embodiment of the invention, similar to that shown in FIG. 10, except that the drill bit includes a joint for pivotally coupling the head with the chassis.

FIG. 13 shows a schematic representation of another embodiment of the invention, similar to that shown in FIG. 10, except that the drill bit 1300 includes a joint 1305 for pivotally coupling head 110 with chassis 105 to account for actuation of off-set mechanism 1305. Embodiments such as those shown in FIG. 13 allow for angular rotation of head 110 instead of parallel offsetting the axis of head 110 as would occur in the embodiment shown in FIG. 10.

Figure 14:
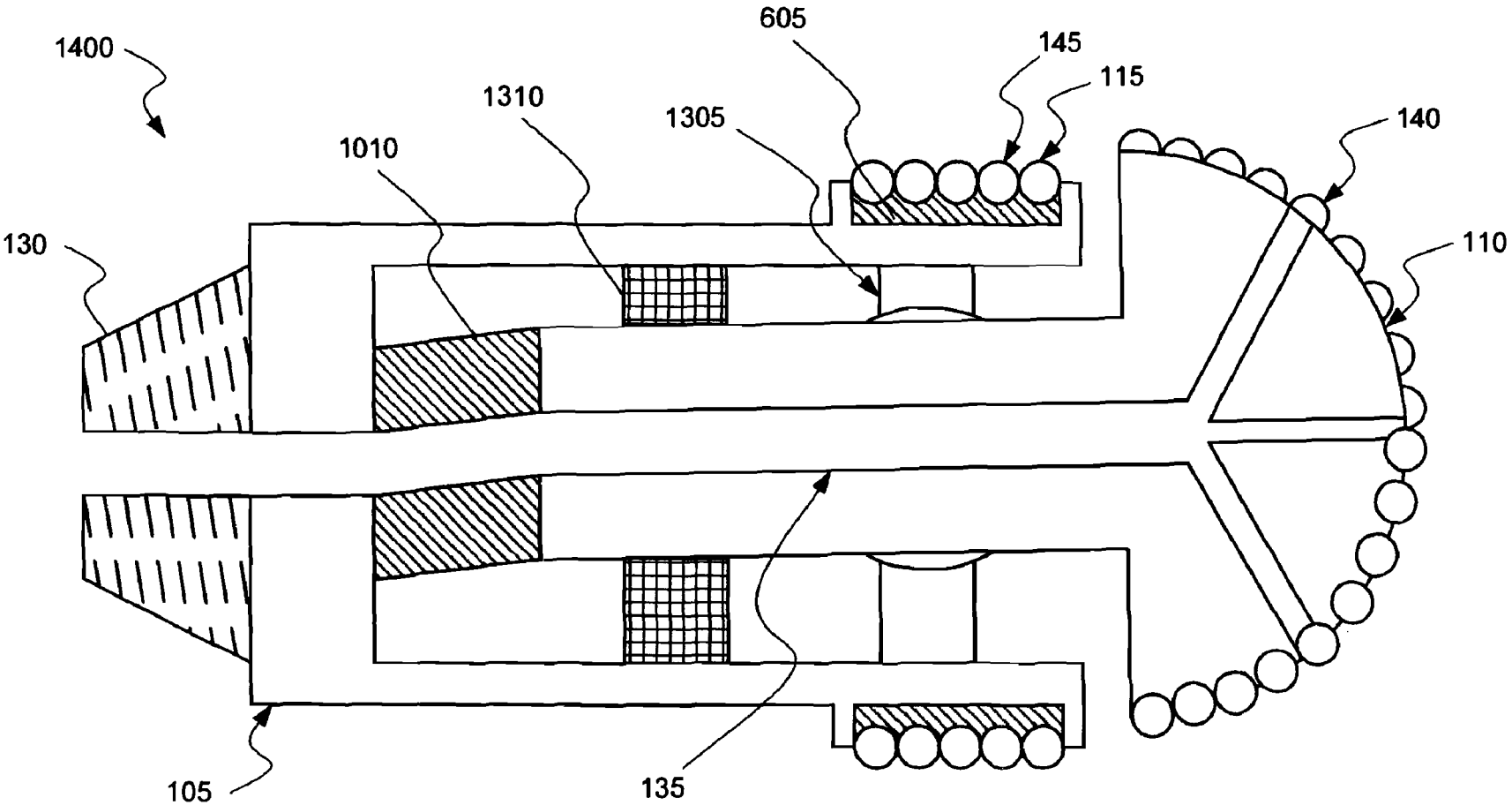
FIG. 14 is a schematic representation of another drill bit embodiment of the invention, similar to that shown in FIG. 13, except that the first plurality of gauge pads are movably coupled with the chassis.

FIG. 14 shows a schematic representation of another drill bit 1400 embodiment of the invention, similar to that shown in FIG. 13, except that first plurality of gauge pads 115 are movably coupled with chassis 105 via compliant medium 605.

Figure 15:
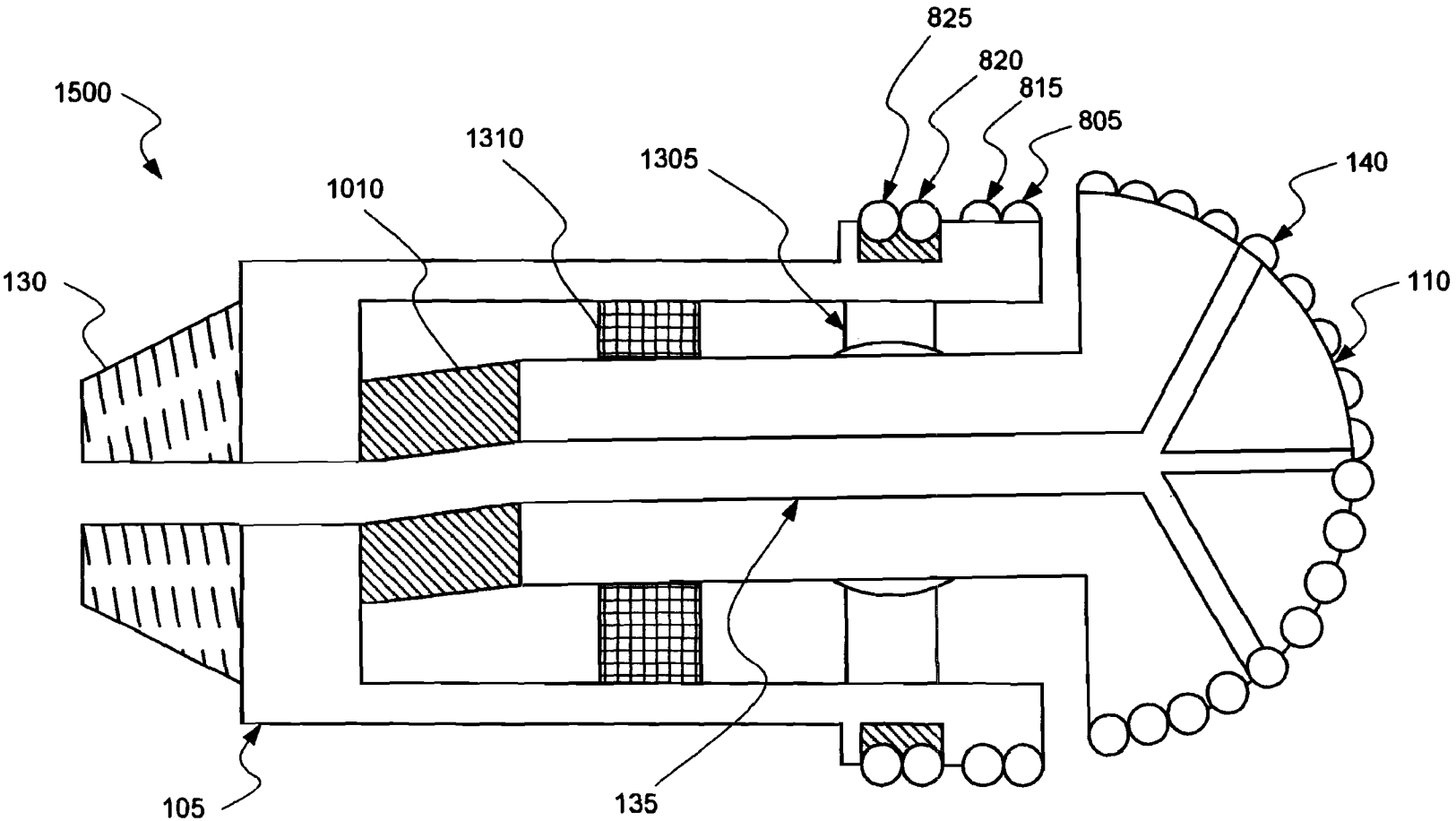
FIG. 15 is a schematic representation of another embodiment of the invention, similar to that shown in FIG. 14, except that the drill bit includes a second plurality of gauge pads fixedly coupled with the chassis.

FIG. 15 shows a schematic representation of another embodiment of the invention, similar to that shown in FIG. 14, except that the drill bit 1500 includes a second plurality of gauge pads 805 fixedly coupled with chassis 105.

Figure 16:
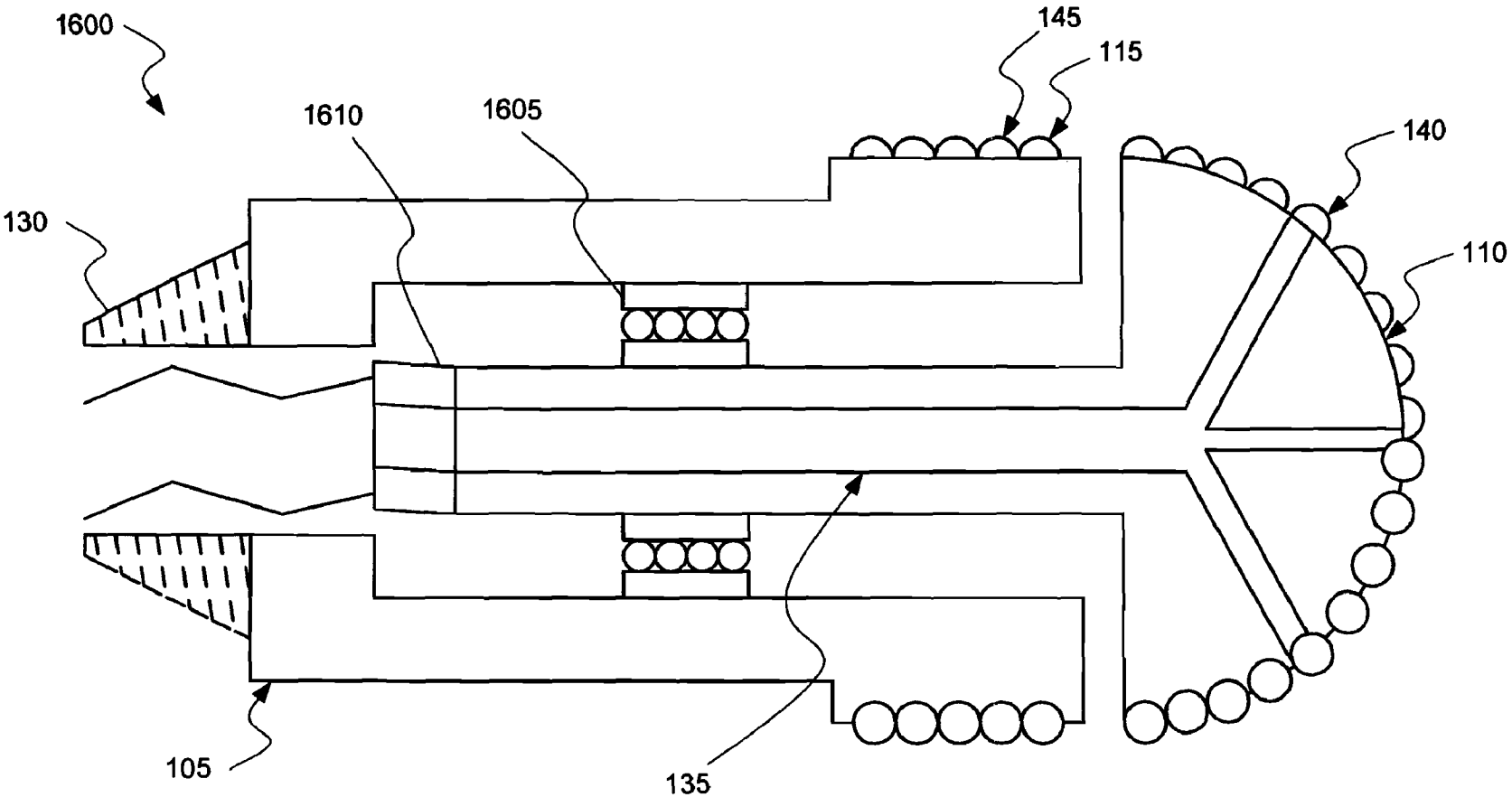
FIG. 16 is a schematic representation of another embodiment of the invention having a drill bit which includes a chassis, a head, a bearing, and a first plurality of gauge pads fixedly coupled with the chassis, where the chassis is configure to be coupled with a first rotational motion source, and the head is configured to be coupled with a second rotational motion source.

FIG. 16 shows a schematic representation of another embodiment of the invention having a drill bit 1600 which includes a chassis 105, a head 110, a bearing 1605, and a first plurality of gauge pads 115 fixedly coupled with the chassis 105, where chassis 105 is configure to be coupled with a first rotational motion source, and head 110 is configured to be coupled with a second rotational motion source via coupling point 1610. Coupling point 1610 allows a fluidic connection to be maintained to drilling fluid passages 135. Embodiments having the features shown in FIG. 16 may allow for selectively different and/or similar rotational speeds to be applied to first plurality of gauge pads 115 and head 110.

Figure 17:
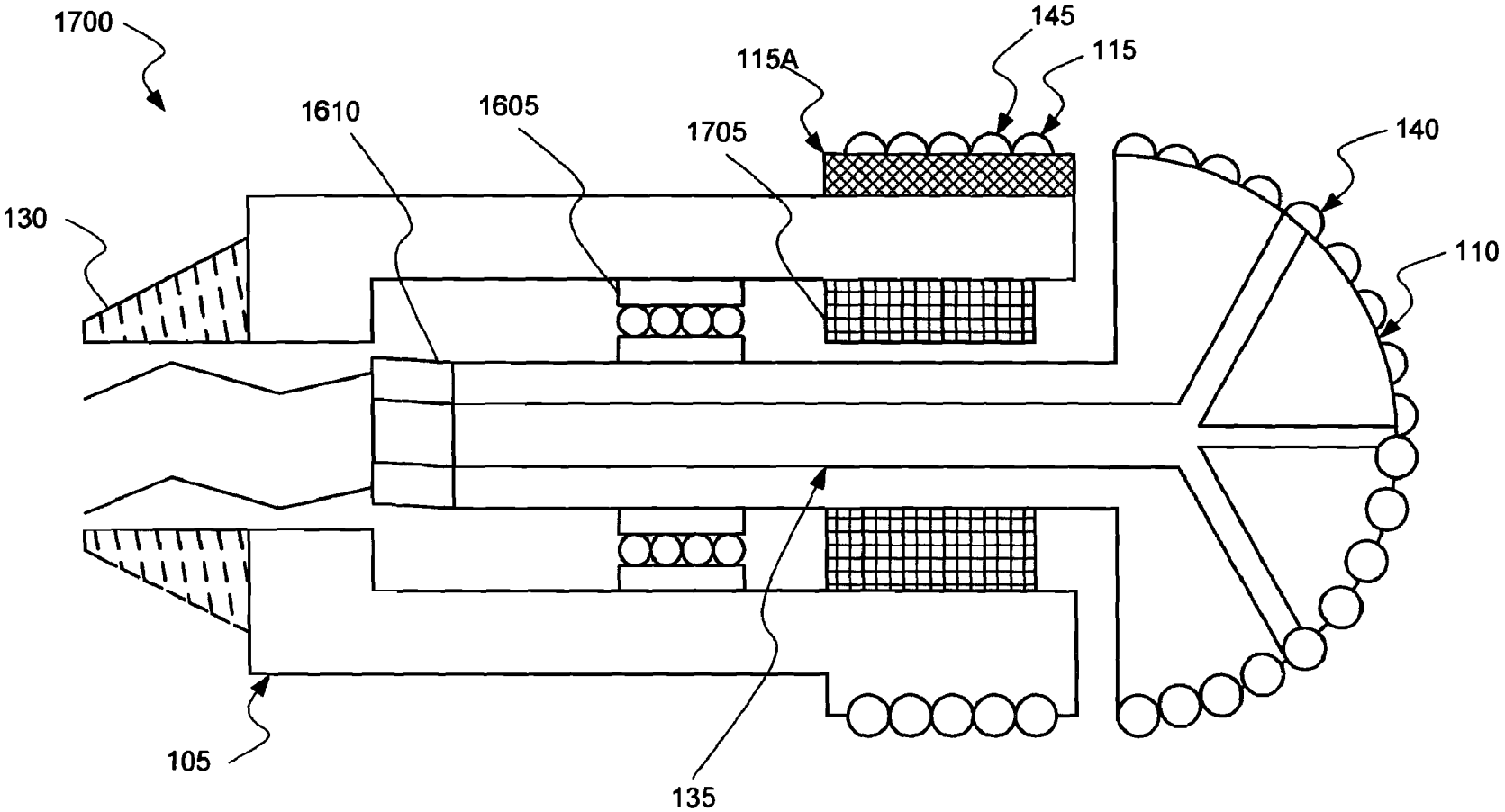
FIG. 17 is a schematic representation of another embodiment of the invention, similar to that shown in FIG. 16, except that the drill bit includes a bias system.

FIG. 17 shows a schematic representation of another embodiment of the invention, similar to that shown in FIG. 16, except that the drill bit 1700 includes a bias system 1705. In certain aspects, the bias system 1705 may allow vibration and/or other forces to be transferred, selectively, from the head 110 to the chassis 105 and hence the first plurality of gauge pads 115. In certain aspects, the gauge pads 115 may include the second plurality of cutters 145. Selective and/or progressive activation of bias system 1705 during specific discrete points or ranges of rotation of head 110 and chassis 105 may allow drill bit 1700 to be steered through the medium and create curved direction cavities.

In an embodiment of the present invention, the bias system 1705 may be configured so as to bias lateral motion of the head 110. For example, as depicted in FIG. 17, the bias system 1705 may undergo lateral motion in a direction towards the top of the figure, but the bias system 1705 may prevent lateral motion of the head 110 in a downward direction. As such, any lateral motion of the head 110 may be biased in an upward direction. Consequently, the drill bit 1700 may drill in an upward direction and may allow drill bit 1700 to be steered through the medium and create curved direction cavities. Moreover, in aspects of the present invention in which the gauge pads 114 include the secondary cutters 145, the motion of the head 110 may be transferred through the bias system to the secondary cutters 145 and provide for side cutting of the borehole. In different embodiments of the present invention, lateral motion of the head 110 may result from the interaction between the head 110 and/or the cutters 140 and the borehole being drilled, a side force applied to the drill bit 1700—such as by a rotary steerable system, a push the bit system, a direct the bit system and/or the like—and/or the like. Merely by way of example, in certain aspects of the present invention, the effect of the bias system 1705 on the head 110 and, as a result, the drilling of the borehole by the drilling bit 1700 may be compared to the effect of a wall on the motion of a drunken person, wherein the drunken person's motion is directed by the shape of the wall.

In some embodiments of the present invention, the gauge pads 115 may be eccentrically coupled with the chassis 105. In such embodiments, the eccentric coupling and/or the biasing system 1705 may provide for directional drilling by the drill bit 1700. In some aspects, the amount of eccentricity may be of the order of 10s of millimeters. In other aspects, the amount of eccentricity of the gauge pads may be in the range between 5 and 10 millimeters. In yet other aspects, the amount of eccentricity of the gauge pads may 1, 2, 3, 4 or 5 millimeters. In still further aspects, the amount of eccentricity may be less than a millimeter, but in such aspects the effect of the eccentricity may be limited.

In one embodiment of the present invention, at least a portion of the gauge pads may under gauge with respect to a cutting diameter of the drill bit, wherein the cutting diameter may comprise a diameter between the outermost cutters 140 of the head. In some aspects of the present invention, the gauge pads 115 and/or a portion of the gauge pads may be under gauge by 10 or more millimeters, between 1-10 millimeters or of the order of tenths of millimeters.

In one embodiment of the present invention, the gauge pads may be distributed non-symmetrically around the chassis. For example, more gauge pads may be grouped on one side of the chassis. The eccentric coupling of the gauge pads, the under-gauge configuration of the gauge pads, the non-symmetric distribution of the gauge pads around the chassis and/or the like may provide for controlling the lateral motion of the head and/or the chassis in the borehole and may provide for interaction with the biasing system 1705.

Figure 18:
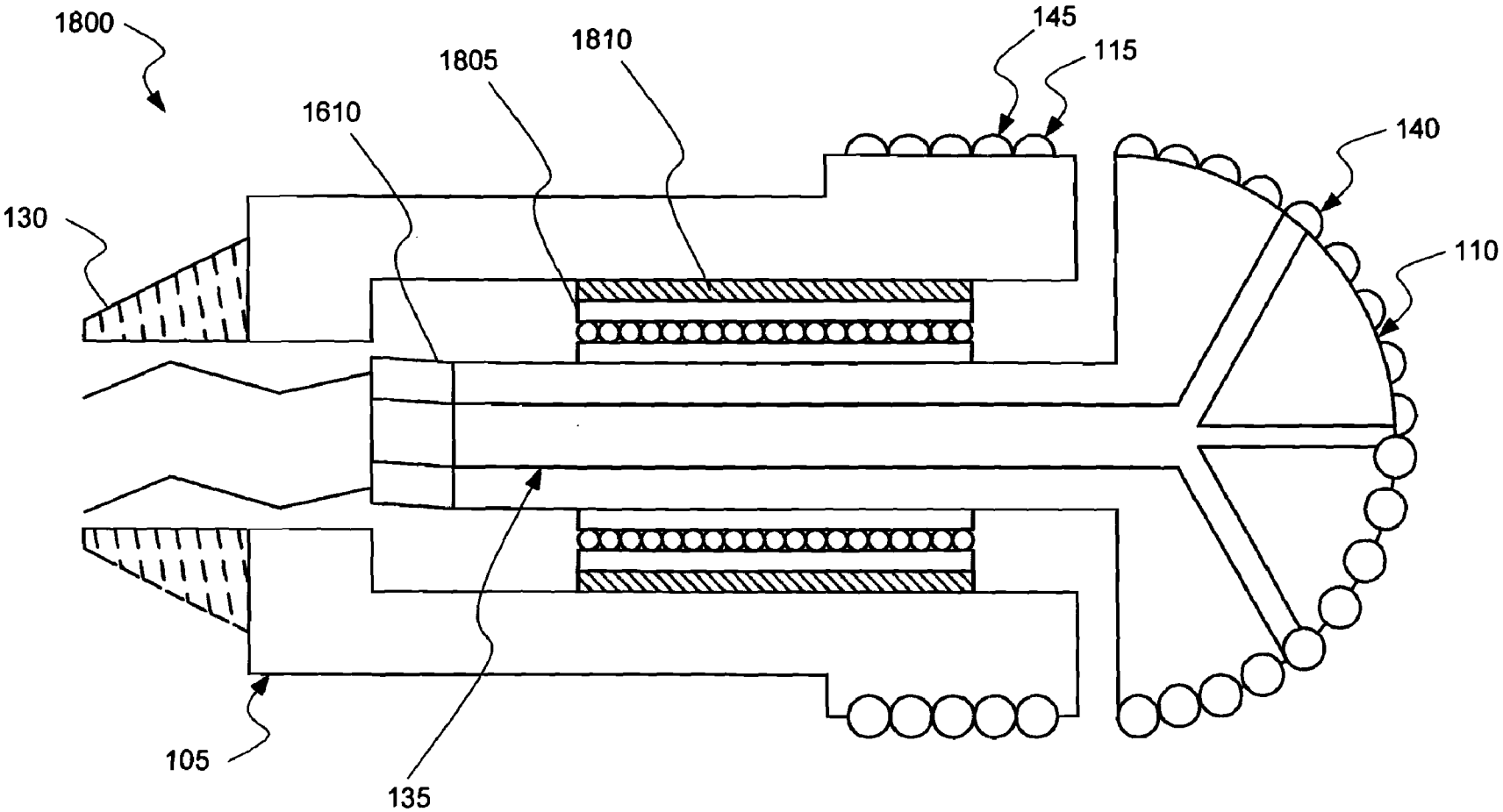
FIG. 18 is a schematic representation of another drill bit embodiment of the invention, similar to that shown in FIG. 16, except that the bearing includes a bias system.

FIG. 18 shows a schematic representation of another drill bit 1800 embodiment of the invention, similar to that shown in FIG. 16, except that the bearing 1805 includes a bias system 1810 internal to its operation. Bias system 1810 may still be controllable as in FIG. 17.

The invention has now been described in detail for the purposes of clarity and understanding. However, it will be appreciated that certain changes and modifications may be practiced within the scope of the appended claims.

What is claimed is:

1. A drill bit system for a drilling assembly, wherein the drill bit system comprises:

a chassis, wherein the chassis is configured to be operably coupled with a first rotational motion source;

a head, wherein:

the head comprises a first plurality of cutters coupled with an end of the head;

the head is rotatably coupled with the chassis; and the head is configured to be operably coupled with a second rotational motion source; and a first set of gauge pads, wherein the first set of gauge pads comprises one or more gauge pads fixedly coupled with the chassis, and wherein the gauge pads are eccentrically coupled to the chassis.

2. The drill bit system for a drilling assembly of claim 1, wherein the first set of gauge pads comprise a second plurality of cutters.

3. The drill bit system for a drilling assembly of claim 1, wherein:

the first rotational motion source has a first rotational speed; and the second rotational motion source has a second rotation speed.

4. The drill bit system for a drilling assembly of claim 1, wherein the drill bit system further comprises a bias system configured to transfer a vibration of the head to the chassis in substantially one direction.

5. The drill bit system for a drilling assembly of claim 4, wherein the bias system is further configured to:

transfer the vibration of the head in a substantially constant lateral direction while the head rotates about its axis.

6. The drill bit system for a drilling assembly of claim 1, further comprising a bias system configured to bias lateral motion of the head to a range of azimuthal angles.

7. The drill bit system for a drilling assembly of claim 6, wherein the range of azimuthal angles is configured to provide for directional drilling by the drill bit system in a desired direction.

8. The drill bit system for a drilling assembly of claim 1, wherein:

the first rotational motion source comprises an above-ground rotational motion source; and the second rotational motion source comprises a mud motor located in a bottom hole assembly.

9. The drill bit system for a drilling assembly of claim 1, wherein the drill bit system further comprises a bearing, and wherein the head being rotatably coupled with the chassis comprises:

the head being operably coupled with the bearing; and the bearing being operably coupled with the chassis.

10. The drill bit system for a drilling assembly of claim 9, wherein the bearing comprises a bias system configured to transfer a vibration of the head to the chassis in substantially one direction.

11. The drill bit system for a drilling assembly of claim 10 wherein the bias system is further configured to:

transfer the vibration of the head in a substantially constant lateral direction while the head rotates about its axis.

12. The drill bit system for a drilling assembly of claim 1, wherein the eccentricity of the gauge pads is between 5 and 10 millimeters.

13. The drill bit system for a drilling assembly of claim 1, wherein the eccentricity of the gauge pads is one of 1, 2, 3, 4 and 5 millimeters.

14. The drill bit system for a drilling assembly of claim 1, wherein at least a portion of the gauge pads are under gauge with respect to a cutting diameter of the drill bit.

15. The drill bit system for a drilling assembly of claim 14, wherein the gauge pads are under gauge by one of a range of 1-10 millimeters.

16. The drill bit system for a drilling assembly of claim 1, wherein the gauge pads are distributed non-symmetrically around the chassis.

17. The drill bit system for a drilling assembly of claim 16, wherein an outer-surface of the chassis is split into two semi-cylinders and more gauge pads are coupled with one of the semi-cylinders.

18. A drill bit system for a drilling assembly, wherein the drill bit system comprises:

a chassis, wherein the chassis is configured to be operably coupled with a first rotational motion source;

a head, wherein:

the head comprises a first plurality of cutters coupled with an end of the head;

the head is rotatably coupled with the chassis; and the head is configured to be operably coupled with a second rotational motion source;

a bias system configured to transfer a vibration of the head to the chassis in substantially one direction; and a first set of gauge pads, wherein:

the first set of gauge pads comprise one or more gauge pads and a second plurality of cutters; and the first set of gauge pads are fixedly coupled with the chassis.

19. The drill bit system for a drilling assembly of claim 18, wherein:

the first rotational motion source has a first rotational speed; and the second rotational motion source has a second rotation speed.

20. The drill bit system for a drilling assembly of claim 18, wherein the bias system is further configured to:

transfer the vibration of the head in a substantially constant lateral direction while the head rotates about its axis.

21. The drill bit system for a drilling assembly of claim 18, wherein:

the first rotational motion source comprises an above-ground rotational motion source; and the second rotational motion source comprises a mud motor located in a bottom hole assembly.

22. The drill bit system for a drilling assembly of claim 18, wherein the drill bit system further comprises a bearing, and wherein the head being rotatably coupled with the chassis comprises:

the head being operably coupled with the bearing; and the bearing being operably coupled with the chassis.

23. A drill bit system for a drilling assembly, wherein the drill bit system comprises:

a chassis, wherein the chassis is configured to be operably coupled with a first rotational motion source;

a head, wherein:

the head comprises a first plurality of cutters coupled with an end of the head;

the head is rotatably coupled with the chassis; and the head is configured to be operably coupled with a second rotational motion source; and a first plurality of gauge pads fixedly coupled with a first sub-chassis, wherein the the first sub-chassis is movably coupled with the chassis.

24. The drill bit system for a drilling assembly of claim 23, wherein the first plurality of gauge pads comprise a second plurality of cutters.

25. The drill bit system for a drilling assembly of claim 23, wherein the first sub-chassis comprises a compliant subsection.

26. The drill bit system for a drilling assembly of claim 23, wherein each of the first plurality of gauge pads is independently movably coupled with the first sub-chassis.

27. A drill bit system for a drilling assembly, wherein the drill bit system comprises:

a chassis for coupling the drill bit system with the drilling assembly;

a drill bit for drilling longitudinally into a medium at a first rotational speed;

a plurality of gauge pads for controlling lateral movement of the second means in the medium;

a bearing for rotatably coupling the drill bit with the chassis; and a rotational motion source for rotating the third means at a second rotational speed.

28. A method of drilling a borehole in a medium, wherein the method comprises:

providing a drill bit, wherein the drill bit comprises:

a drill head; and one or more gauge pads, wherein the one or more gauge pads are coupled with the drill head via a compliant coupling;

rotating the drill head at a first rotational speed;

rotating the plurality of gauge pads at a second rotational speed; and changing a compliance characteristic of the compliant coupling to change a direction of the drill bit in the medium.

29. The method of drilling a borehole in a medium of claim 28, wherein the compliance characteristic comprises a level of compliance in a geostationary direction.

30. The method of drilling a borehole in a medium of claim 29, wherein the step of rotating the plurality of gauge pads at the second rotational speed comprises rotating the plurality of gauge pads so that the plurality of gauge pads remain geostationary in the borehole.

* * * * *